US006620346B1

(12) United States Patent
Schulz et al.

(10) Patent No.: US 6,620,346 B1
(45) Date of Patent: Sep. 16, 2003

(54) VARISTORS BASED ON NANOCRYSTALLINE POWDERS PRODUCED BY MECHANICAL GRINDING

(75) Inventors: Robert Schulz, Ste-Julie (CA); Sabin Boily, Chambly (CA); Alain Joly, Sutton (CA); André Van Neste, Ste-Foy (CA); Houshang Alamdari, Ste-Julie (CA)

(73) Assignee: Hydro-Quebec, Montreal (CA)

( * ) Notice: Subject to any disclaimer, the term of this patent is extended or adjusted under 35 U.S.C. 154(b) by 0 days.

(21) Appl. No.: 09/485,401

(22) PCT Filed: Aug. 11, 1998

(86) PCT No.: PCT/CA98/00769

§ 371 (c)(1),
(2), (4) Date: Apr. 28, 2000

(87) PCT Pub. No.: WO99/09564

PCT Pub. Date: Feb. 25, 1999

(30) Foreign Application Priority Data

Aug. 13, 1997 (CA) ..... 2211813

(51) Int. Cl.[7] ..... H01B 1/08; H01C 7/112
(52) U.S. Cl. ..... 252/519.51; 264/617
(58) Field of Search ..... 252/519.51; 338/22 R; 264/617

(56) References Cited

U.S. PATENT DOCUMENTS

| | | | | |
|---|---|---|---|---|
| 4,681,717 A | | 7/1987 | Brooks et al. | 264/61 |
| 5,952,040 A | * | 9/1999 | Yadav et al. | 427/126.3 |
| 6,184,770 B1 | * | 2/2001 | Nakamura et al. | 338/21 |
| 6,228,904 B1 | * | 5/2001 | Yadav et al. | 523/210 |

FOREIGN PATENT DOCUMENTS

| | | |
|---|---|---|
| DE | 26 51 274 | 5/1977 |
| DE | 33 35 354 | 4/1985 |

OTHER PUBLICATIONS

Boily, S. et al, "Materials Science Forum Vols. 235–238", Ball Milled ZnO for Varistor Applications., pp. 993–998 and {1}References List attached, 1 page (157).
Brankovic, Z. et al, "NanoStructured Materials, vol. 4 No. 2", Nanostructured Constituents of ZnO–Based Varistors Prepared by Mechanical Attrition, pp. 149–157, (1994).
Shirakawa, S. et al, Evaluation of Electrical Uniformity, 7 pages.
Chen, Ying–Chung, et al, "Japanese Journal of Applied Physics, vol. 30, No. 1", Grain Growth and Electrical Properties in ZnO Varistors with Various Valence States of Additions, pp. 84–90, (Jan. 1991).
Matsuoka, M. et al, "Japanese Journal of Applied Physics, vol. 10, No. 6", Nonohmic Properties of Zinc Oxide Ceramics, pp. 736–746, (Jun. 1971).

(List continued on next page.)

*Primary Examiner*—Mark Kopec
(74) *Attorney, Agent, or Firm*—Foley & Lardner

(57) ABSTRACT

The invention concerns novel varistors based on zinc oxide and a method for making same, which consists in using as base products nanocrystalline powders obtained by high-intensity mechanical grinding and in subjecting the mixture resulting from said nanocrystalline powders a consolidating treatment such as sintering, in suitably selected temperature and time conditions so as to retain the smallest possible grain size of ZnO. The resulting varistors have a very fine homogeneous microstructure and an average grain size characteristically not more than 3 mu m, i.e. five times smaller than standard materials. Said novel varistors have a larger number of grain boundaries per length unit and therefore a much higher breakdown voltage. Said voltage is characteristically higher than 10 kV/cm and can reach 17 kV/cm which is almost one order of magnitude above the breakdown voltage of standard varistors. The non-linearity coefficient of the current-voltage curve is also improved, and is greater than 20 and can reach values as high as 60. Moreover, the leakage currents below the breakdown voltage of said varistors, are much weaker.

21 Claims, 19 Drawing Sheets

OTHER PUBLICATIONS

Chen, Chang–Shun et al, "Japanese Journal of Applied Physics, vol. 35, Pt. 1, No. 9A", Electrical Properties of ZnO Varistors Prepared by Microwave Sintering Process, pp. 4696–4703, (1996).

Nobrega, Maria Cecilia S. et al, "J. Am Ceram Soc. vol. 79, No. 6", Varistor Performance of ZnO–Based Ceramics Related to Their Densification and Structural Development, pp. 1504–1508, (Jun. 1996).

Asokan T., Studies on microstructure and density of sintered ZnO–based non–linear resistors, pp. 2229–2236, (1987 Chapman and Hall Ltd.).

Cahn, R.W. et al, "Physical Metallurgy, Part II, Chapter 30", Sintering Processes, pp. 1899–1912, (1983).

German, Randall M., Powder Metallurgy Science, $2^{nd}$ Edition, Chapter 7, Sintering, pp. 242–294.

Walker Jr., William J. et al, Granule Fracture During Dry Pressing, pp. 53–57, (Jun. 1999).

Gupta, Tapan K., J. Am. Ceram. Soc., 73 [7], *Journal of Zinc Oxide Varistors*, pp. 1817–1840, (1990).

Einzinger, R. et al., "Ann. Rev. Mater. Sci., 17", *Metal Oxide Varistors*, pp. 299–321, (1987).

"Microemulsion Mediated Synthesis of Zinc–Oxide Nanoparticles for Varistor Studies" by S. Hingorani, V. Pillai, P. Kumar, M.S. Multani and D.O. Shah; Nat, Mat. Res. Bull., vol. 28, pp. 1303–1310, 1993.

"Effect of Process Variables on the Grain Growth and Microstructure of ZnO–$Bi_2O_3$ Varistors and Their Nanosize ZnO Precursors" by Sunita Hingorani and D.O. Shah, J. Mater. Res., vol. 10, No. 2, pp. 461–467, 'Feb. 1995.

"Impedance Spectroscopy of Grain Boundaries in Nanophase ZnO" by J. Lee. –H. Hwang, J.J. Mashek, T.O. Mason, A.E. Miller and R.W. Siegel, J. Mater. Res., vol. 10, No. 9, pp. 2295–2300, Sep. 1995.

"Preparation and Characterization of Nanocrystalline ZnO Based Materials for Varistor Applications" by R.N. Viswanath, S. Ramasamy, R. Ramamoorthy, P. Jayavel and T. Nagarajan, NanoStructured Materials, vol. 6, pp. 993–996, 1995.

* cited by examiner

S2-1000 (1h)

290413 25KV X2.00K 15.0um

S2-1000 (2h)

290412 25KV X2.00K 15.0um

S2-1000 (2.5h)

2% $SiO_2$, 1000°C, 2000X

S2-1200 (2.5h)

2% $SiO_2$, 1200°C, 2000X

VARISTORS BASED ON NANOCRYSTALLINE POWDERS PRODUCED BY MECHANICAL GRINDING

FIELD OF THE INVENTION

The present invention relates to a new method for manufacturing varistors using nanocrystalline powders obtained by intensive milling.

It also relates to the so manufactured varistors, which differ from similar products presently available in particular in that they have a very high break-down voltage.

BRIEF DESCRIPTION OF THE PRIOR ART

It has been known for a great numbers of years to use varistors containing zinc oxide to protect electrical equipments against over-voltages. Varistors are electrically active elements whose impedance varies in a non-linear manner as a function of the voltage applied to its terminals. These elements are usually in the form of pellets having a diameter of 3 to 100 mm and a thickness of 1 to 30 mm. They essentially consist of a material made of conducting grains of zinc oxide (ZnO) surrounded by insulating grain boundaries made of bismuth oxide ($Bi_2O_3$). After pressing, the pellets are subjected to sintering in a furnace at temperatures ranging from 1000 to 1500° C. for several hours.

At low voltages, the insulating barriers at grain boundaries prevent the current from flowing. Therefore, the material acts as an insulator. When the voltage exceeds a given value called "break down voltage", the resistance of the boundaries decreases rapidly, thereby making the material a variable resistance or "varistor". The material becomes then very conductive and the current can be diverted to the ground instead of damaging the electric equipment. Because of their structure, the varistors are mainly used in lightning-arresters like those of the electric energy transportation and distribution networks.

The lightning arresters presently available on the market usually comprise an insulating envelope in the form of a cylindrical tube. This envelope defines a cavity in which are mounted one or several columns of varistors packed one above the others. Each lighting arrester is connected in parallel to the electric equipment to be protected, in order to reduce the over-voltage that may be produced at the terminals of the same. From a practical standpoint, each lightning-arrester forms a normally open circuit which is "converted" into a closed circuit parallel to the equipment to be protected as soon as a significant over-voltage occurs at the terminals of the equipment. Such permits to reduce the insulation level of the electric equipment that is protected.

However, it is worth mentioning that there are numerous other potential applications for varistors, especially for the protection of secondary networks, domestic electric equipments, electronic or miniaturized equipments, etc.

Presently, there are numerous varistors available on the market, which are made of zinc oxide. By way of example of such varistors useful in lightning-arresters, reference can be made to those sold under the trademarks RAYCHEM and SEDIVER. These varistors are manufactured by sintering a mixture of powders of ZnO, $Bi_2O_3$ and, optionally, other oxides such as $Sb_2O_3$ and/or $SiO_2$ at temperatures of about 1,200° C. These varistors have an average grain size higher than 3 $\mu$m (about 10 $\mu$m for the RAYCHEM varistors and about 6 $\mu$m for the SEDIVER varistors). Their break-down voltage is proportional to the numbers of grain boundaries or insulating barriers of $Bi_2O_3$ per unit length. Such break-down voltage is typically lower than 2.5 kV/cm (about 1.6 kV/cm for the RAYCHEM varistors and about 2 kV/cm for the SEDIVER varistors).

There are numerous scientific articles dealing with the structure and properties of ZnO-based varistors. Some of these articles suggest that the use of a pure or doped nanosize ZnO powder as a starting material would have numerous advantages, including, in particular, a substantial increase of their break-down voltage and of the coefficient of non-linearity of their current-voltage curve (hereinafter called "coefficient $\alpha$"). Indeed, the break-down voltage seems to be inversely proportional to the ZnO grain size and, accordingly, to the sintering temperature.

By way of example of such articles, reference can be made to the following:

- S. HINGORANI et al, "Microemulsion mediated synthesis of zinc-oxide nanoparticles for varistor studies", Mat. Res. Bull., 28 (1993), 1303
- S. HINGORANI et al, "Effect of process variables on the grain growth and microstructure of ZnO—$Bi_2O_3$ varistors and their nanosize ZnO precursors", J. of Materials Research, 10 (1995), 461;
- J. LEE et al, "Impedance spectroscopy of grain boundaries in nanophase ZnO", J. of Materials Research, 10 (1995) 2295;
- R. N. VISWANATH et al, "Preparation and characterization of nanocrystalline ZnO based materials for varistor applications", Nanostructured materials, 6 (1995), 993.

In these articles, nanoparticles of ZnO are prepared by microemulsion (see the articles of S. HINGORANI et al), by gaseous phase condensation (see the article of J. LEE et al) or by colloid suspension and centrifugal separation (see the article of R. N. VISWANATH et al). In all the cases, the obtained powder is pressed to form a pellet or a disc which is then subjected to sintering at a temperature which can be as low as 600° C. to 750° C. to avoid undue increase of the crystallite size (see the articles of R. N. VISWANATH et al and J. LEE et al) or as high as 1,200° C. (see the articles of S. HINGORANI et al).

Recently, an article was published by the present inventors in the proceedings of ISMANAM-96. This article entitled "Ball milled ZnO for varistor applications", reports the result of tests carried out on pellets prepared from a nanocrystalline powder of pure ZnO obtained by intensive mechanical grinding and subsequently subjected to pressing and sintering at 1,250° C. for 1 hour. These tests show that the so-obtained pellets have no varistor effects, contrary to those obtained from nanosize powder of ZnO obtained by gaseous phase condensation (see again the article of J. LEE et al).

In an article of Z. BRANKOVIC et al, <<Nanostructure constituents of ZnO-based varistors prepared by chemical attrition >>, Nanostructured Materials, 4 (1994), 149, there is disclosed a method for manufacturing a varistor comprising the following steps:

a) first preparing each of the main constituent phases of a ZnO-based varistor;

b) mixing together powders of the constituent phases;

c) intensively milling the powers after the mixing so that the obtained powders be nanocrystalline; and d) submitting the so-milled mixture to a consolidation treatment comprising a pressing followed by a sintering at a temperature of 1,100° C. (1,373° K.) for 1 hour.

The final product that is so obtained, has the characteristics of a conventional varistor. The ZnO grain size ranges between 5.5 and 7.5 μm (see Table 2), that is in the typical range of conventional varistors. Moreover, the break down voltages have a value comprised between 4.1 and 6.6 KV/cm. The author mentions: "There is no significant difference in electrical properties between the milled samples and sample Z1 (the reference sample) sintered under the same conditions, but the milled samples have higher values for the sintered density . . . It is evident that varistor mixtures which were intensively milled before sintering are more active for sintering process. It is the consequence of increase of surface free energy and defects concentration, as well as uniform distribution of powder particles and a decrease of powder particles size".

U.S. Pat. No. 4,681,717 discloses a chemical process for manufacturing varistors, comprising the coprecipitation of metals followed by an oxidation by calcination and a sintering at a temperature of 675 to 740° C. for periods exceeding 4 hours. The so-obtained varistors are disclosed as having a grain size lower than 1 μm, a break-down voltage of 10 to 100 KV, a coefficient α of non-linearity higher than 30 and a density of about 65 to 99% of the theoretical density depending on the composition and the sintering temperature.

SUMMARY OF THE INVENTION

It has now been discovered that if:

on the one hand, use is made as starting materials of conventional or nanocrystalline powders obtained by intensive milling; and on the other hand, the mixture obtained from these powders is subjected to an intense milling followed by a consolidation treatment including a sintering under such time and temperature conditions that ZnO keeps a grain size as low as possible;

one may obtain varistors having a very fine and homogeneous microstructure with an average grain size typically lower than or equal to 3 μm, which is 3 to 5 times smaller than the grain size of conventional materials.

These new varistors have a higher numbers of grain boundaries per unit length and therefore a much higher break-down voltage. This break-down voltage is typically higher than 10 kV/cm and may be as high as 17 kV/cm, which is about one order of magnitude higher than the break-down voltage of conventional varistors. For a given operating voltage, such increase in performance permits, in principle, to reduce proportionally the size of the equipment protecting devices.

The coefficient α of non-linearity of the current-voltage curve is also substantially improved. It is higher than 20 and can reach value as high as 60 whereas it is of about 40 for the varistors of trademark SEDIVER and 36 for those of trademark RAYCHEM.

In addition, the leakage current below the break-down voltage of the varistors that are so manufactured, is smaller.

Accordingly, the first object of the present application is to provide a method for the manufacture of a varistor having a very high breakdown voltage, comprising the steps of:

(a) mixing powders of zinc oxide (ZnO) and bismuth oxide ($Bi_2O_3$) with at least one other powder of an additive capable of influencing the properties of varistors, said mixing being carried with such amounts of powders that the zinc oxide represents at least 75 mol % of the resulting mixture;

(b) subjecting the powders to an intensive milling before, during or after their mixing by means of a high energy ball mill in such a manner that the obtained powders be nanocrystalline; and (c) subjecting the mixture of nanocrystalline powder that is so-obtained to a consolidation treatment, characterized in that said consolidation treatment (c) includes a sintering and is carried out under time and temperature conditions selected to keep a zinc oxide grain size lower than 3 μm and a low porosity.

Preferably, the intensive milling step (b) is carried out after the mixing step (a).

The powder of zinc oxide used a starting material can be milled before the mixing step (a), either alone or in combination with doping agents such as $Al_2O_3$. In parallel, the powder of bismuth oxide and all the other selected additives can be mixed, milled and treated at a high temperature equal to or higher than the one of step (c) before the mixing step (a).

Preferably also, the oxide powders or their mixture are calcinated at a temperature equal to or lower than 550° C., before carrying out step (c) and before or after carrying out the intensive milling step (b), and the sintering made during the consolidation treatment of step (c) is carried out at a temperature lower than 1,200° C. for a period of time equal to or lower than 2.5 hours. The heating rate to reach the sintering temperature is advantageously comprised between 0.5 and 1,200° C./min and is preferably of about 1° C./min.

Another object of the invention is to provide a varistor containing zinc oxide (ZnO) and bismuth oxide ($Bi_2O_3$), whenever obtained by the method disclosed hereinabove. This varistor has a very high break-down voltage, which is typically higher than 10 kV/cm, and numerous other interesting properties, including, in particular, a high coefficient ox of non-linearity of its current-voltage curve, and a small leakage-current. More precisely, the so manufactured varistor contains at least 75 mol % of ZnO and has the following characteristics:

it has a very fine and homogeneous microstructure with an average ZnO grain size lower than 3 microns;

it has a breakdown voltage higher than 10 kV/cm;

it has a coefficient of non-linearity of current-voltage higher than 20; and it has a very small leak current below its breakdown voltage.

The varistors according to the invention are useful as protective elements for primary and secondary networks, electric equipments and electronic or miniaturized components. For example, they can be used for the manufacture of lightning arresters for the protection of transformers. They can also be used in electric outlets for protecting domestic electric equipments against over-voltages. They can further be used in micro-circuitry for protecting electronic components.

Thanks to their properties, and more particularly, to their high break-down voltage, the varistors according to the invention can be miniaturized, thereby permitting numerous applications that could not have been foreseen with conventional materials. Thus, for example, the conventional varistors have a relatively low break-down voltage (about 1.6 kV/cm for the varistors of trademark RAYCHEM). As a result, for an operative voltage of 30 kV, which is usually the one required for the protection of a distribution transformer, a stacking of varistor of 18.75 cm long is required in a lightning arrester. With the varistors according to the invention which can easily have a break-down voltage of 16 kV/cm or more (see the following detailed description), a varistor with a thickness of 2 cm or a stacking of varistors of 2 cm long will be sufficient to obtain the same protection against over-voltage higher than 30 kV/cm.

The invention and its numerous advantages will be better understood upon reading the following non-restrictive detailed description.

DETAILED DESCRIPTION OF THE INVENTION

Thus, a first object of the invention is to provide a method for the manufacture of a zinc oxide (ZnO)—and bismuth oxide (Bi2O3)—based varistor having a very high breakdown voltage.

This method comprises two first steps, hereinafter called mixing step (a) and milling step (b), which can be combined or inverted.

Step (a) consists in mixing powders of zinc oxide (ZnO) and bismuth oxide ($Bi_2O_3$) with one or more other powders of other additives capable of influencing the characteristics of the varistor.

These other additives are preferably selected from the group consisting of metal oxides, carbides, nitrides, nitrates and hydrides that are capable of doping the varistors, modifying the characteristics of their current-voltage curves, modifying the resistivity of phases, reducing their leakage current, increasing their capacity of dissipating energy, controlling their porosity, slowing down the grain growth, increasing their structural integrity, altering the melting points of the phases and increasing their chemical, electrical, mechanical and thermal stabilities. These metal oxides, carbides, nitrides, nitrates and hydrides preferably contains the following elements: Si, Sb, Mn, Ge, Sn, Pb, Nb, B, Al, Ti, Ta, Fe, S, F, Li, Ni, Cr, Mo, W, Be, Br, Ba, Co, Pr, U, As, Ag, Mg, V, Cu, C, Zr, Se, Te and Ga.

In accordance with a particularly preferred embodiment of the invention, the additives that are used are selected from the group consisting of antimony oxide ($Sb_2O_3$), manganese oxide ($MnO_2$), alumina ($Al_2O_3$), silica ($SiO_2$) tin oxide ($SnO_2$), niobium oxide ($Nb_2O5$) cobalt oxide (CoO or $Co_3O_4$), iron oxide ($Fe_2O_3$ or $Fe_3O_4$) and titanium oxide ($TiO_2$ or TiO). The amount of powders that is used during the mixing step (a) is then preferably selected so that the mixture comprises:

from 0.25 to 10 mol % $Bi_2O_3$ from 1.5 to 4 mol % $Sb_2O_3$ from 0.5 to 4 mol % $MnO_2$ from 0.00125 to 0.05 mol % $Al_2O_3$ from 0 to 4 mol % of $SiO_2$ from 0 to 2 mol % $SnO_2$ from 0 to 2 mol % $Nb_2O_5$ from 0 to 2.5 mol % CoO from 0 to 2.5 mol % $Fe_2O_3$ and from 0 to 3 mol % $TiO_2$ the balance consisting of ZnO.

In all cases, it is essential that the mixture be prepared in such a manner that the amounts of powder of zinc oxide present in the mixture be equal to at least 75% mol.

Among the various oxides listed hereinabove, bismuth oxide ($Bi_2O_3$) used as a starting material together with zinc oxide (ZnO) is essential to obtain a good insulation between the grains of ZnO and, accordingly, a high varistor effect.

Antimony oxide ($Sb_2O_3$) is known to inhibit the grain growth and prevent the transfer of ions in the bismuth-rich liquid phase during the consolidation treatment.

Silica ($SiO_2$) is known to inhibit the grain growth and modify the stability of varistors under continuous electrical constraints.

Manganese and cobalt oxides are known to increase the coefficient a of non-linearity of the varistor and to favorize the interface states.

Iron and niobium oxides as well as the $Al^{3+}$ cation are also known to increase the coefficient $\alpha$.

Last of all, titanium oxide (TiO2) is known to increase the size of the grains, which is something that should be avoided in accordance with the invention. However, $TiO_2$ reacts with ZnO to form particles of $Zn_2TiO_4$, which seem to increase the nucleation rates and, accordingly, to lead to a much more homogeneous grain size distribution.

The milling step (b) of the method according to the invention is absolutely essential. It consists if subjecting the powders of oxides and/or additives to an intensive mechanical grinding before, during or after their mixing by means of a high energy ball mill in such a manner that the obtained powders be nanocrystalline.

Preferably, this milling step (b) is carried out after the mixing of the powders, that is after the mixing step (a). However, the mixing step can be carried out while the powders are milled, by adding each of the powders one after the other into the ball mill. One can also mill separately each of the powders and thereafter only mix the same.

Thus, for example, the powder of zinc oxide used as a starting material can be milled prior to the mixing step (a), either alone or in combination with doping agents such as $Al_2O_3$. In parallel, the powder of bismuth oxide and all the other additives can be mixed, milled and treated at a high temperature equal to or higher than the one of step (c) prior to the mixing step (a).

The milling can be carried out in, for example, a high energical ball mill like those of trademarks SPEX or ZOZ®, having a crucible made of tungsten carbide or chromium steel. Whatever be the equipment that is used, it is essential that the powders contained in the obtained mixture be nanocrystalline.

According to a particularly preferred embodiment of the invention, the nanocrystalline powders that are so prepared are subjected to calcination at a temperature equal to or lower than 550° C. This calcination can be carried out on each of the prepared powders when these powders are separately milled. However, the calcination is preferably carried out directly onto the powders after mixing.

After calcination, the mixture can be processed in order to form pellets. This can be achieved by introducing a binder such as polyvinyl alcohol (PVA) into the mixture and subjecting the mixture in which the binder has been introduced to a pressing to form the requested pellets. It must be understood that the mixture may have other forms and thus could be obtained by extrusion or lamination. The powders and PVA can be mixed into a crucible identical to the one of the ball mill for a period of about one hour. The mixture containing the binder can then be pressed under a pressure 500 Mpa or more.

The next step for the method according to the invention is another essential step. This step identified by letter (c) in the "Summary of the invention" and in the appended claims, consists of subjecting the milled and optionally processed mixture to a consolidation treatment including a sintering carried out under temperature and time conditions selected so that the zinc oxide simultaneously keeps the smallest grain size and a low porosity.

The consolidation treatment may also include another treatment consisting of a pressing under different atmospheres ($O_2$, Ar, air, $N_2$, $SF_6$, . . . ), rolling, extrusion, wire-drawing, plasma-spray injection and the like. The treatment preferably involves heating which can be a convection heating, an induction heating, a microwave heating, a laser heating or an electric discharge heating, and which can be carried out either in a continuous manner or for one or several periods of time (rapid thermal annealing, pulse treatment, etc) during or after the consolidation.

According to a particularly preferred embodiment of the invention, the sintering step (c) is carried out in an electric furnace at a temperature lower than 1,200° C. for a period of time equal to or lower than 2.5 hours. From a practical standpoint, such a sintering must be carried out at a temperature higher than 800° C. to ensure that the bismuth oxide is molten and fully distributed around the zinc oxide grains in order to achieve the requested insulation. However, this sintering must not be carried out at a too high temperature, as such may unduly increase the size of the grains and/or may evaporate some additives.

According to a preferred embodiment of the invention, the sintering is preferably carried out at 1,000° C. for a period of time equal to or lower than 1.5 hours.

The heating rate to reach the selected sintering temperature is preferably comprised between 0.5 and 10° C./min, the preferred value being 1° C./min. Indeed, it has been discovered that the higher is the heating rate, the higher will be the porosity of the obtained varistor, which is something to be avoided.

Last of all, after the consolidation treatment, the obtained pellets can then be cooled at ambient air. As previously indicted, the so obtained varistors have excellent properties.

Thus:

- they have a very fine homogenous microstructure and an average grain size of ZnO that is lower than 3 $\mu$m and preferably lower than or equal to 2 $\mu$m;
- they have a break-down voltage higher than 10 kV/cm;
- they have a coefficient a of non-linearity of their current-voltage curve higher than 20 and preferably higher than 40 or even 60; and
- they have a very small leakage current below the break-down voltage.

The following examples contain the results of tests carried out by the Applicant. Together with the accompanying drawings, these examples will permit to better appreciate the advantages of the varistors according to the invention.

For simplicity's sake, the varistors prepared in accordance with the invention have been identified as follows in the examples and accompanying drawings:

Sa-b(c)

wherein:

- S indicates that the varistor contains silica;
- a is the percentage expressed in mol of silica present in the varistor;
- b is the sintering temperature; and
- c is the sintering time, expressed in hours.

Thus, for example, S2-1,000 (1.5 h) designates a varistor containing 2 mol % of silica, which was prepared by sintering at 1,000° C. for 1.5 hours.

EXAMPLE 1

Preparation of S2-1.000 (2.5 h) Varistors

Figure 1:
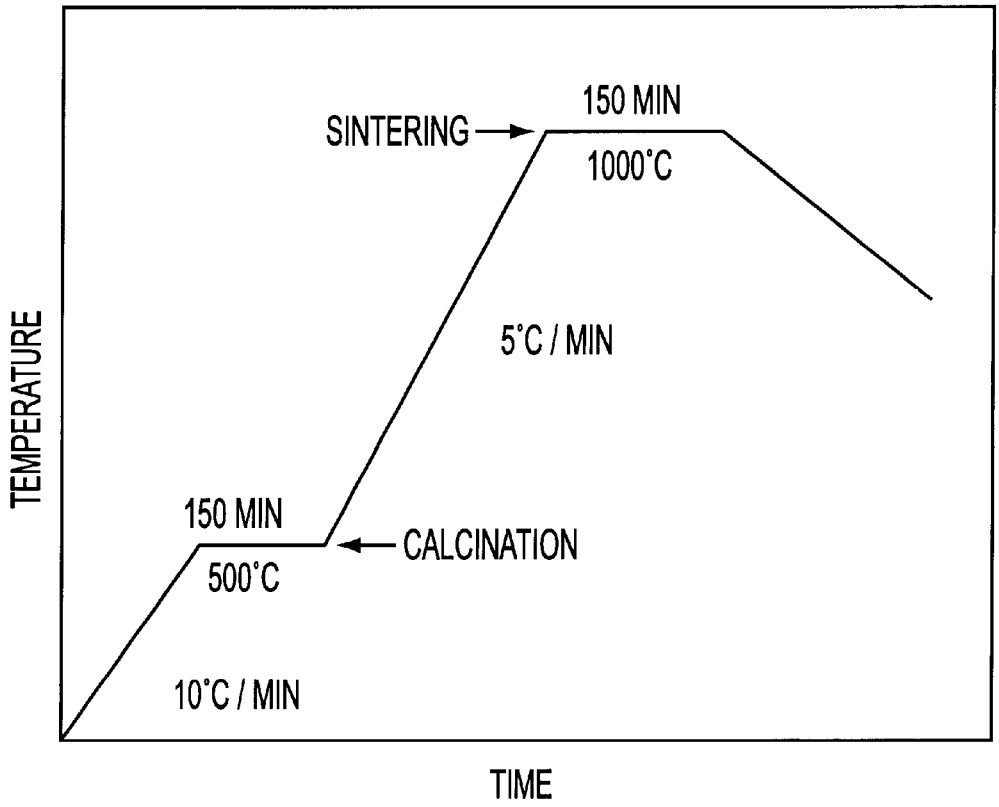
FIG. 1 is a graphical representation of a method of manufacture of varistors according to a preferred embodiment of the invention, giving the temperatures at which the calcination and sintering are carried out as a function of the time.

A 99.99% pure of ZnO powder (obtained from Aldrich) was mixed with 3 mol % of $Bi_2O_3$, 2 mol % of $Sb_2O_3$, 2.5 mol % of $MnO_2$, 2 mol % of $SiO_2$ and 0.005 mol % of $Al_2O_3$. The whole mixture weighted 10 grams. It was sealed under air into a steel crucible (60 cc) containing three steel balls of 11 mm diameter and was then milled at ambient atmosphere for 10 hours within a milling machine operating at 700 rpm.

The size of the crystallites after milling was of a few tenths of nanometer.

The powder mixture that was obtained, was then calcinated at ambient atmosphere at 500–550° C. for 2.5 hours and was mixed with 2% by weight of PVA used as a binder. The powder mixture and PVA were milled for one hour in a crucible identical to the one used for the preparation of the mixture.

The powder with the binder incorporated therein was pressed under a pressure of 550 MPa to form pellets of 9 mm diameter and 1.5 thickness.

The pellets were then heated at a speed of 5° C./min (heating rate) in an electric furnace until they reached a sintering temperature of 1,000° C. at which they were kept for 2.5 hours. Once the sintering was completed, they were cooled within the furnace by switching off the electric supply (cooling rate of about 5° C./min down to 500° C.).

FIG. 1 gives the temperature profile of the treatment carried out onto the powder mixture as a function of the time.

The sintered pellets that were obtained, were polished with sand paper to reach a final thickness of 1 mm in order to conduct electric tests. Electric contacts were applied on both sides thereof by evaporation of gold.

The characteristics of the material forming the varistors that were so produced, were determined as follows.

The size of the ZnO crystallites was evaluated from the peak (100), of X-ray diffraction curves taken with a diffractometer Siemens D-5000, using a Cu—Kα radiation, positioned at 31.8°, and the Scherrer formula.

The microstructure of the pellets was examined with a scanning electronic microscope (model JEOL JSN 840A and HITACHI S-570) equipped with an image analyser. The size of the grain was evaluated from the obtained micrographics.

The chemical composition of the material that was so obtained was as follows:

| | |
|---|---|
| ZnO | 90.495 mol % |
| $Bi_2O_3$ | 3 mol % |
| $Sb_2O_3$ | 2 mol % |
| $SiO_2$ | 2 mol % |
| $MnO_2$ | 2.5 mol % |
| $Al_2O_3$ | 0.005 mol % |

The following table gives the average grain size of ZnO within the material that was obtained and the percentage by weight of its principal elements, measured by EDX. It also gives, for comparison purpose, the size of the ZnO grain and the percentage by weight of the elements of the materials sold under the trademark RAYCHEM and SEDIVER.

TABLE

| Average grain size of ZnO | Invention 2 μm | RAYCHEM 10 μm | SEDIVER 6 μm |
|---|---|---|---|
| ZnO | 76% by weight | 92% by weight | 90% by weight |
| $Bi_2O_3$ | 14,4 | 4 | 3 |
| $Sb_2O_3$ | 6 | 1.5 | 4 |
| $SiO_2$ | 1.2 | — | — |
| $MnO_2$ | 2.2 | — | — |

EXAMPLE 2

Preparation of a S2-1,000 (1h) Varistors

By using the same starting products and the same molar percentages as in example 1, a first mixture of $Bi_2O_3$ and $Al_2O_3$ was made. This first mixture was subjected to high energy milling for 10 h in an apparatus of trademark SPEX. Then, the first mixture was subjected to a pressing under a pressure of 160 MPa in order to obtain a first pellet. This first pellet was then sintered at 1,100° C. for 1 hour, and subsequently broken into chunks.

The chunks of the first pellet was then mixed with a 99.99% pure powder of ZnO. The second mixture that was so obtained was subjected to high energy milling for 10 h in the same SPEX apparatus. The second mixture obtained after milling was then calcinated at 550° C. for 2.5 h and mixed with 2% by weight of PVA used as a binder. The obtained mixture of powder and PVA was then pressed in the form of a second pellet under a pressure of 630 MPa. This second pellet was subjected to a sintering at 1,000° C. for 1 hour, and was cooled in the sintering furnace.

Figure 16:
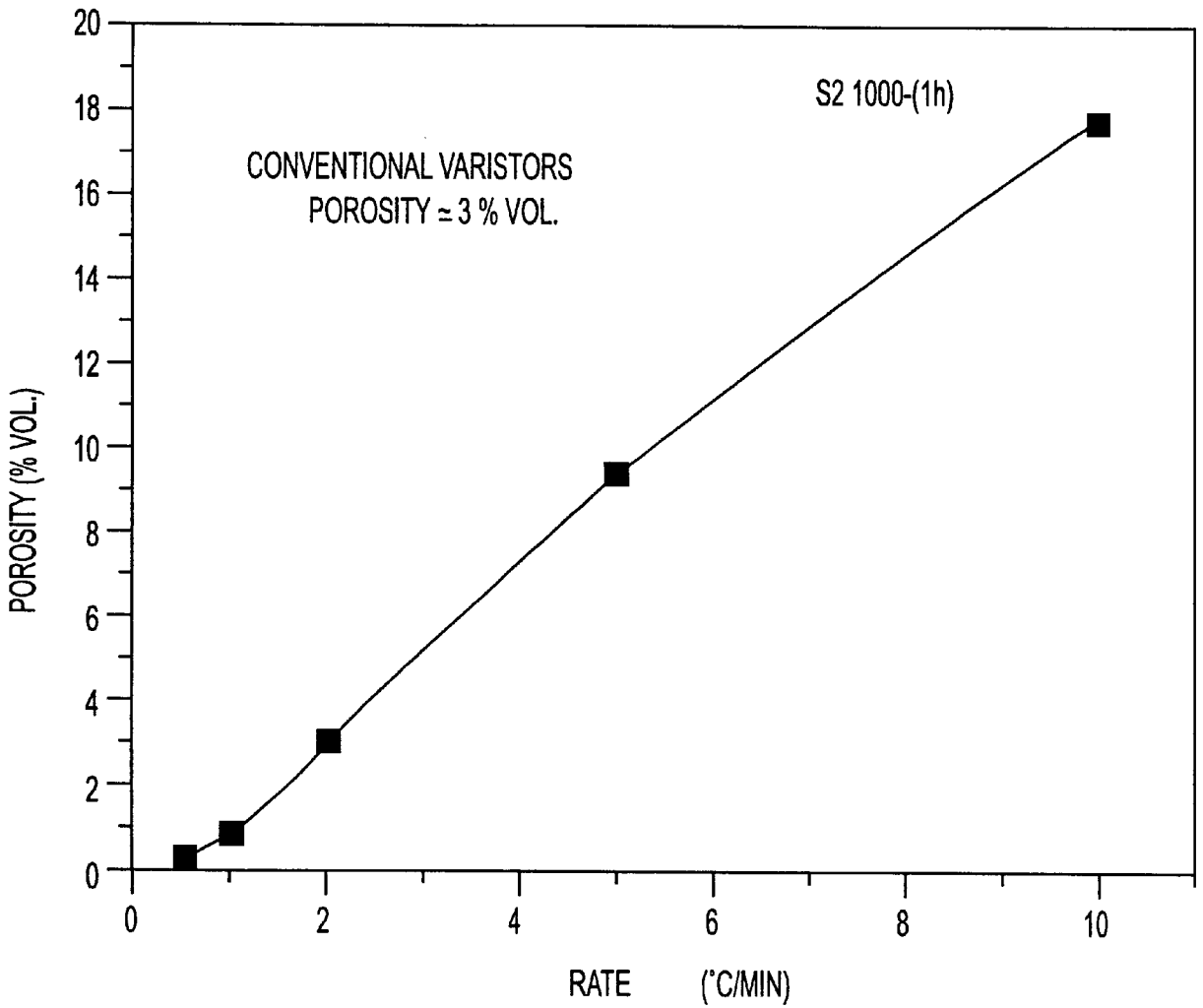
FIG. 16 is a curve giving the value of the porosity (expressed in volume %) as a function of the heating rates (expressed in ° C. per minute) during the sintering step in the case of a varistor S2-1,000 (1 h) according to the invention.

The so-obtained second sintered pellet was treated and tested in the same manner as in example 1 and has proved to have substantially the same electrically property but a clearly lower porosity (by a factor of 2)—see FIG. 16.

EXAMPLE 3

Preparation of S2-1,000 (1 h) Varistors

By using the same starting materials and the same molar percentages as in example 1, one proceeded substantially in the same manner as in example 2, except that, in the first prepared mixture, ZnO- doping agents such as $Al_2O_3$ were excluded to limit the mixture exclusively to the materials called "of grain boundaries", that is $Bi_2O_3$, $Sb_2O_3$, $MnO_2$ and $SiO_2$. This first mixture was subjected to the same first milling, pressing and sintering as in example 2, under the same conditions.

In parallel to this treatment, the pure powder of ZnO was milled with its doping agent $Al_2O_3$ for 1 h in a SPEX apparatus, and the so-obtained, milled powder was mixed with chunks of the first sintered pellet that was obtained. This new mixture was then subjected to the same second milling, calcination, addition of PVA, pressing and sintering as in example 2.

The sintered second pellet obtained as a final product has proved once again to have substantially the same electrical properties as those obtained in examples 1 and 2, but a much lower porosity than in example 1.

EXAMPLE 4

Evaluation of the I-V Characteristics of S2-1,000 (2.5 h) varistors

The current-voltage (I-V) characteristics of S2-1,000 (2.5 h) varistors were measured by using a resistometer Hewlett-Packard HP-4339A, following the conventional 4 points method. The applied voltage was ranging from 0.1 to 1,000 V. The current was measured over a range of $10^{-8}$ to $10^{-1}$ mA.

Figure 2A:
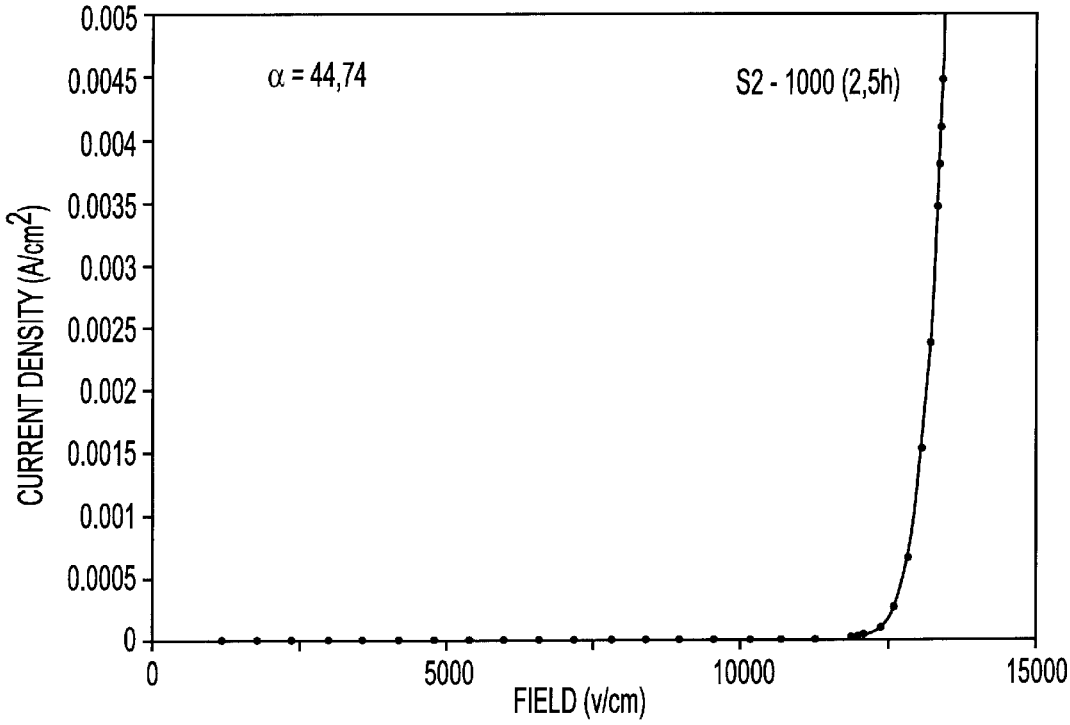
FIG. 2*a* is a curve giving the current density (expressed in A/cm$^2$) as a function of the electrical field (expressed in V/cm) in the case of a varistor S2-1,000 (2.5 h) according to the invention.
Figure 2B:
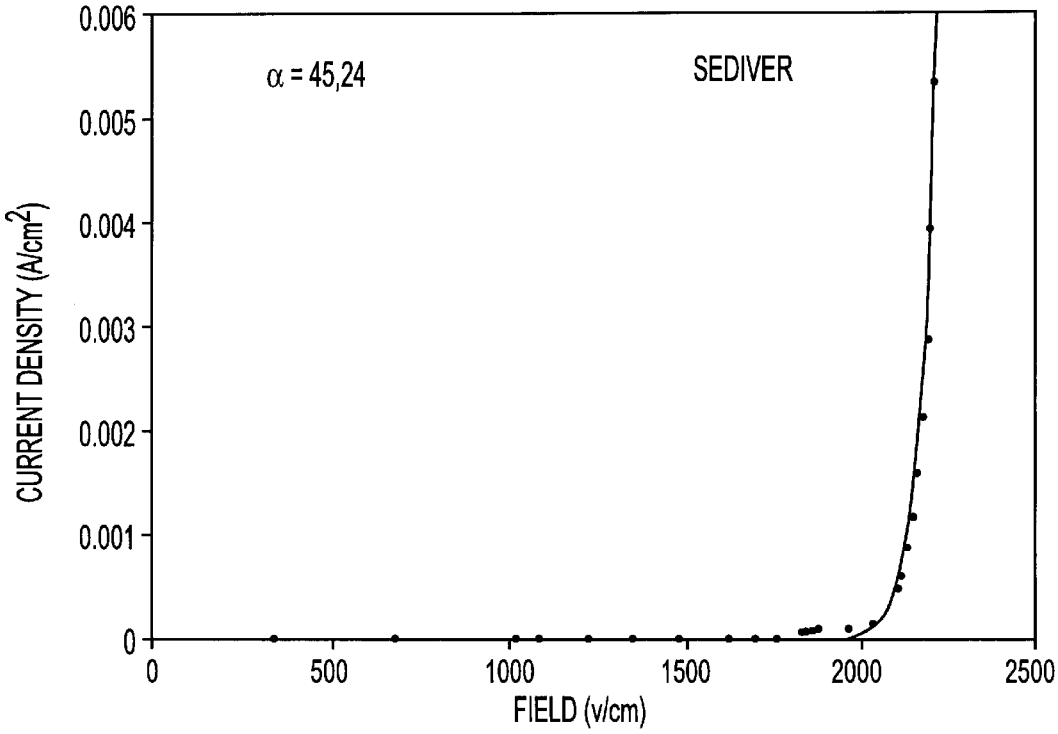
FIG. 2b (PRIOR ART)
FIG. 2*b* identified as illustrative of the "prior art" is the curve similar of the one shown in FIG. 2*a*, giving the current density as a function of the electric field in the case of a varistor of trademark SEDIVER.

FIG. 2*a* is a curve giving the value of the current density as a function of the voltage field (V/cm) in the case of a S2-1,000 (2.5 h) varistor. FIG. 2*b* is a curve similar to the one of FIG. 2*a*, giving the value of the current density as a function of the voltage field in the case of a varistor of trademark SEDIVER.

As can be noticed, the break-down voltage of the S2-1,000 (2.5 h) varistor according to the invention is close to 12.5 kV/cm and its coefficient of non-linearity $\alpha$ is equal to 44.7. The leakage current below the break-down voltage ranges from $1\times10^{-7}$ to $2\times10^{-6}$ A/cm$^2$. The leakage current is better shown in FIG. 3*a*.

The break-down voltage of the conventional varistor of trademark SEDIVER is close to 2 kV/cm and its coefficient of non-linearity a is equal to 45.2. Its leakage current below the break-down voltage ranges from $1\times10^{-6}$ to $1\times10^{-4}$ A/cm$^2$. This leakage current is shown in FIG. 3*b*, which is given for comparison purpose.

EXAMPLE 5

Evaluation of the Importance of the Sintering Time

Figure 3A:
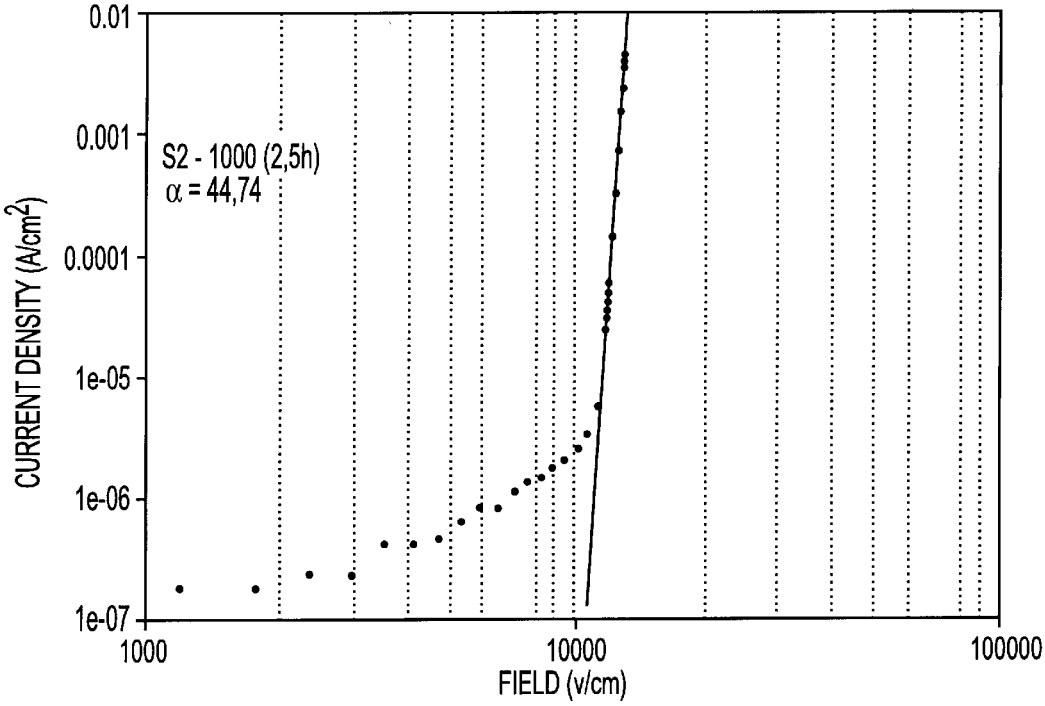
FIG. 3*a* is a curve similar to the one of FIG. 2*a* but on a logarithm scale, this curve illustrating the leakage current below the break-down voltage in the case of a varistor S2-1,000 (2.5 h) according to the invention.
Figure 3B:
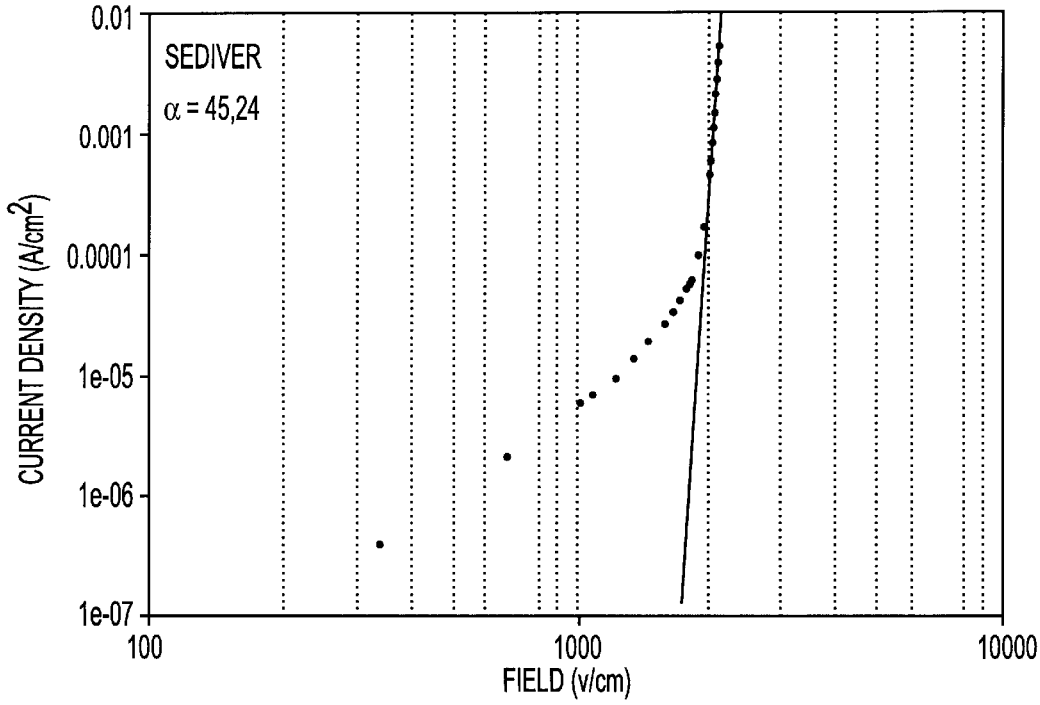
FIG. 3b (PRIOR ART)
FIG. 3*b* identified as illustrative of the prior art, is a curve similar to the one of FIG. 3*a*, giving the leakage current below the break-down voltage of the varistor of trademark SEDIVER.
Figure 4:
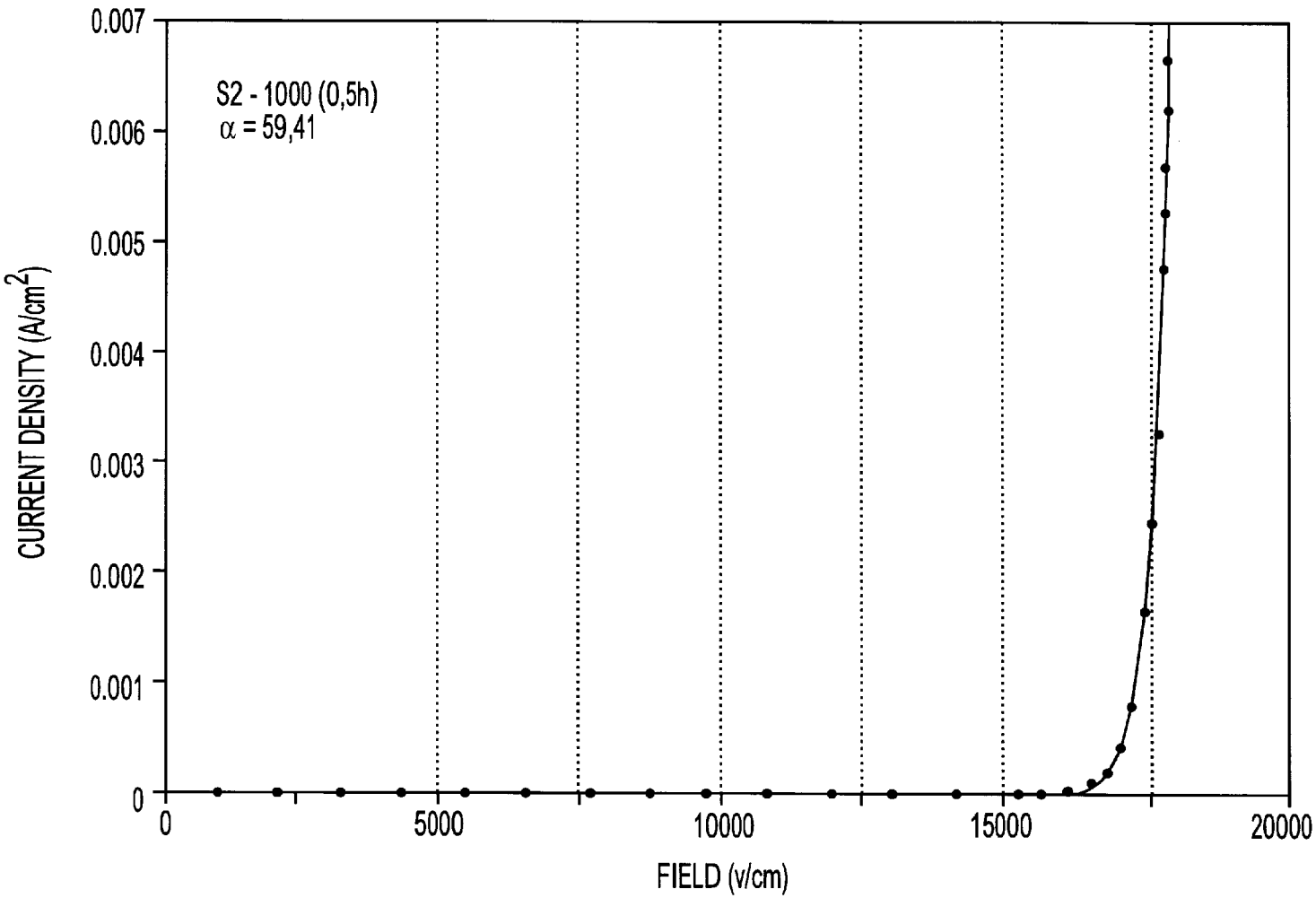
FIG. 4 is a curve similar to the one of FIG. 2*a*, giving the current density as a function of the electric field in the case of a varistor S2-1,000 (0.5 h) according to the invention.
Figure 5:
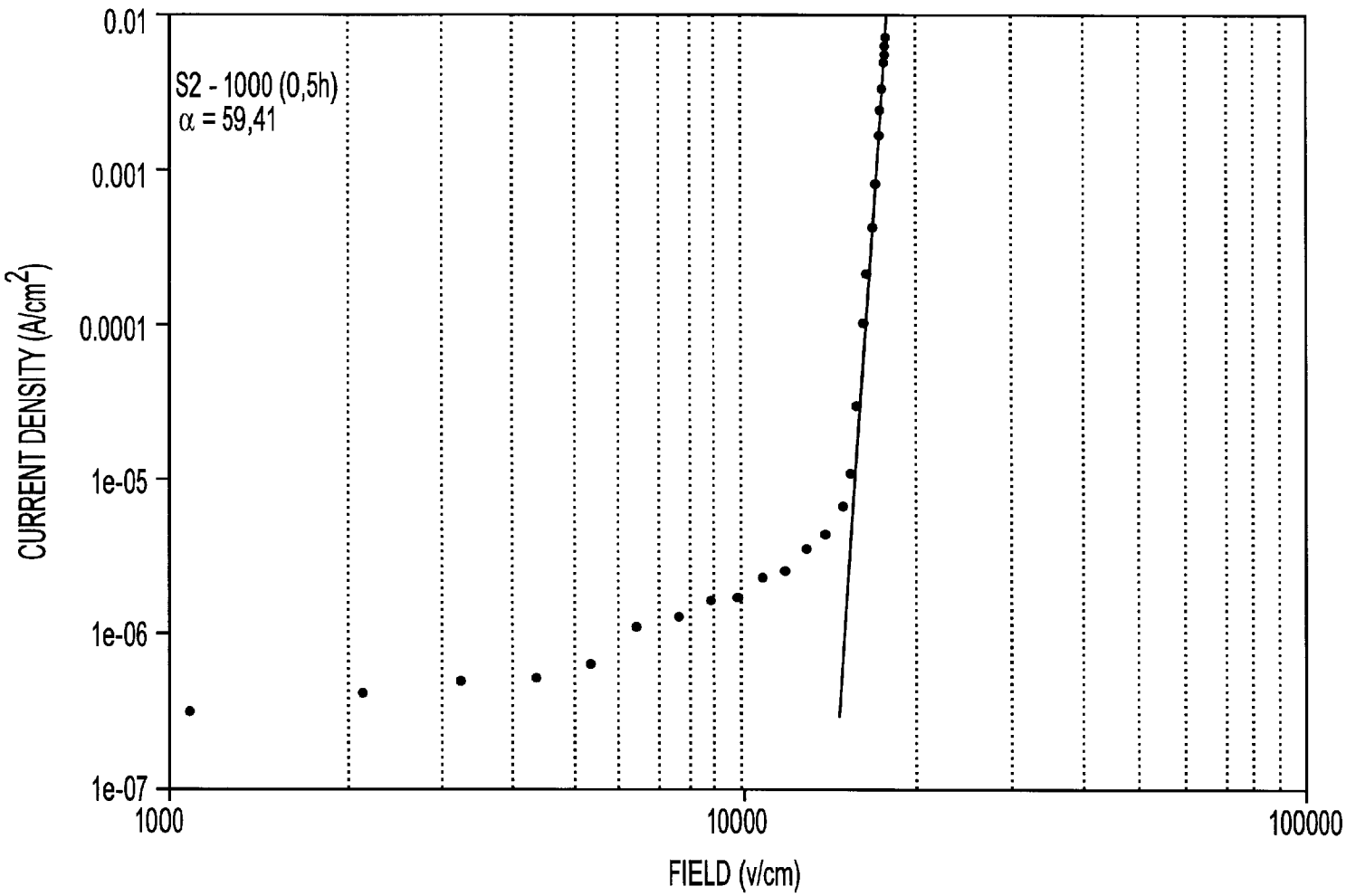
FIG. 5 is a curve similar to the one of FIG. 3*a*, illustrating the leakage current below the break-down voltage in the case of a varistor S2-1,000 (0.5 h) according to the invention.
Figure 6:
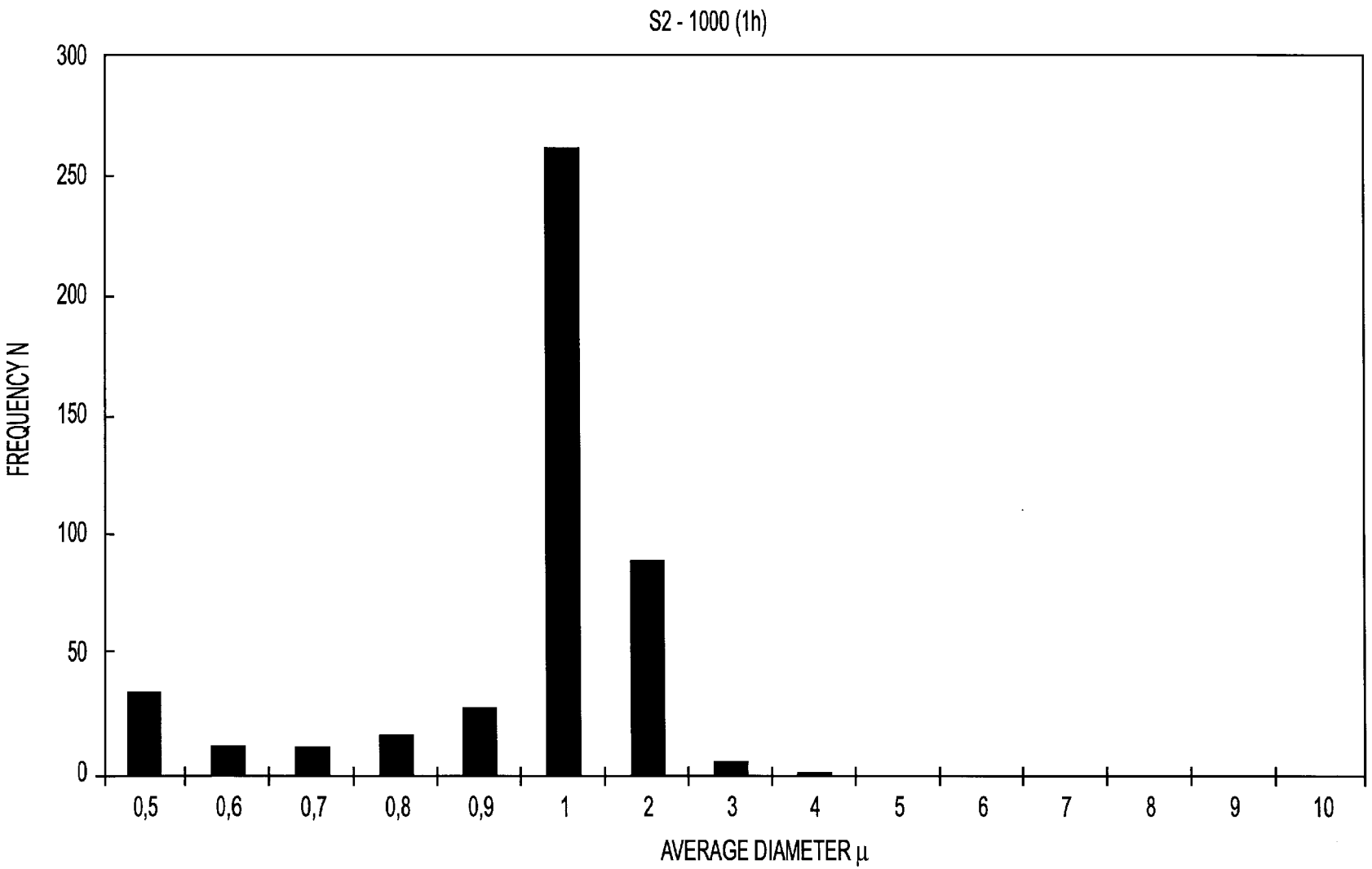
FIG. 6 is an histogram illustrating the distribution of the average diameter (expressed in $\mu$m) of the particles of ZnO in a varistor S2-1,000 (1h) according to the invention.
Figure 7:
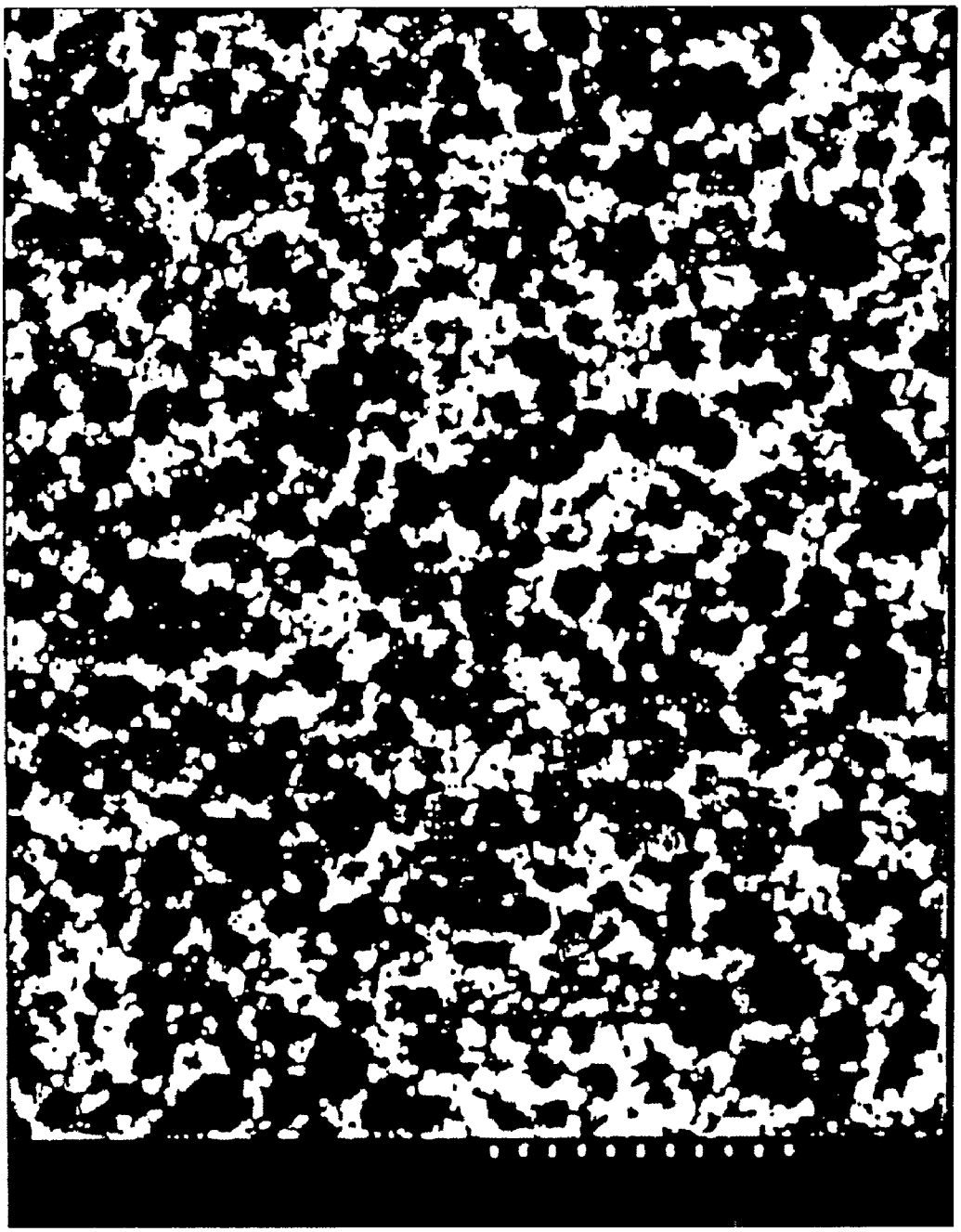
FIG. 7 is a micrography (magnification 2000×) of the microstructure of a varistor S2-1,000 (1 h), of which the average diameter of the particles is shown in FIG. 6.

FIGS. 4 and 5 are curves similar to those shown in FIGS. 2*a* and 3*a*. These curves give the value of the current density as a function of the voltage field and the value of the leakage current of a S2-1,000 (0.5 h) varistor having exactly the same composition and prepared in the same manner as the S2-1,000 (2.5 h) varistor, except that the sintering time was 0.5 h instead of 2.5 h.

As can be seen, the break-down voltage is in the range of 16 kV/cm. Thus, it seems that the shorter is the sintering time, the smaller is crystallite size and the higher is the break-down voltage. However, a too short sintering time (or sintering carried out at a too low temperature) does not solve the porosity problem which may affect the quality of the varistors.

Figure 8:
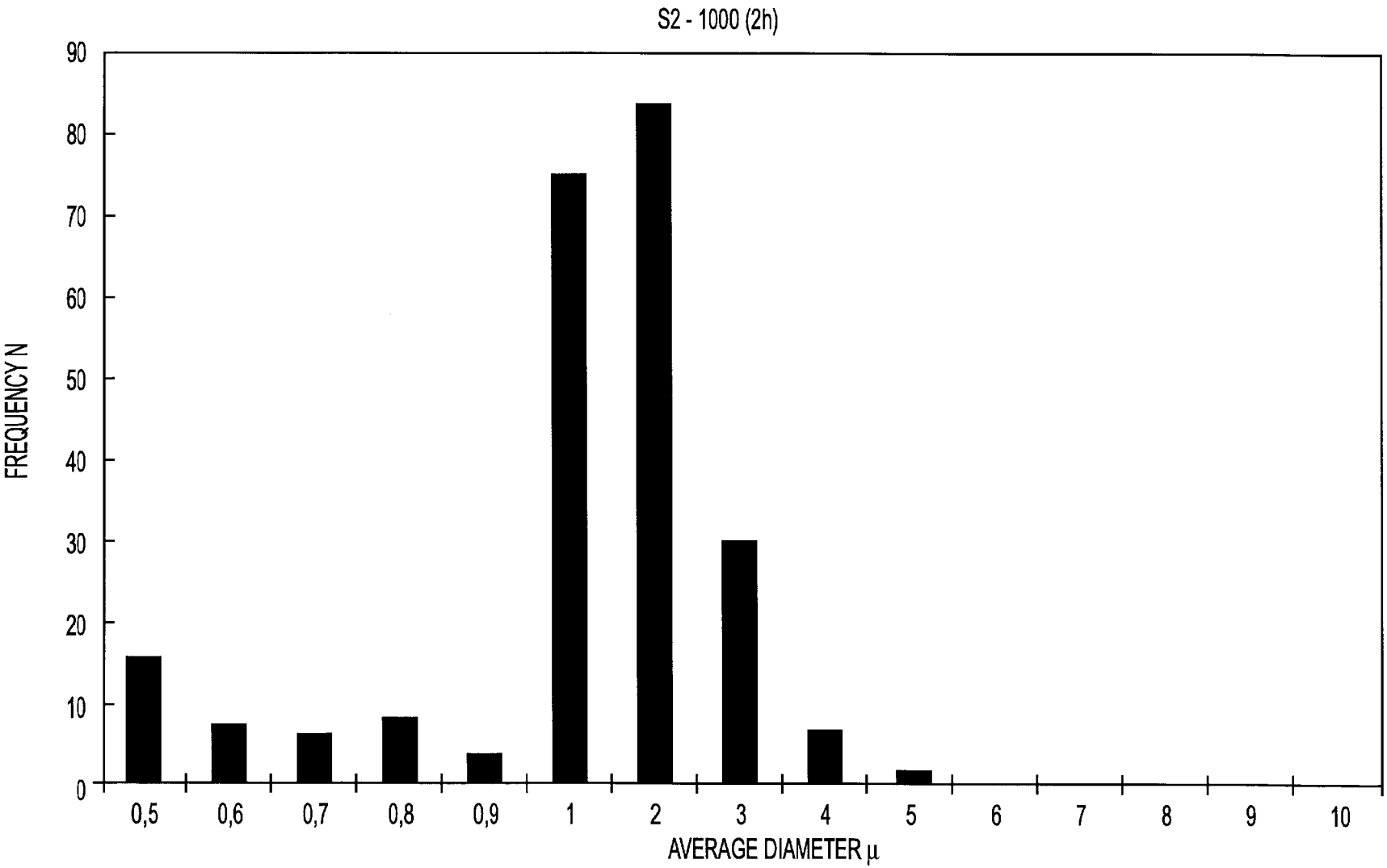
FIG. 8 is an histogram similar to the one of FIG. 6, showing the average diameter distribution of the particles of ZnO in a varistor S2-1,000 (2 h) according to the invention.
Figure 9:
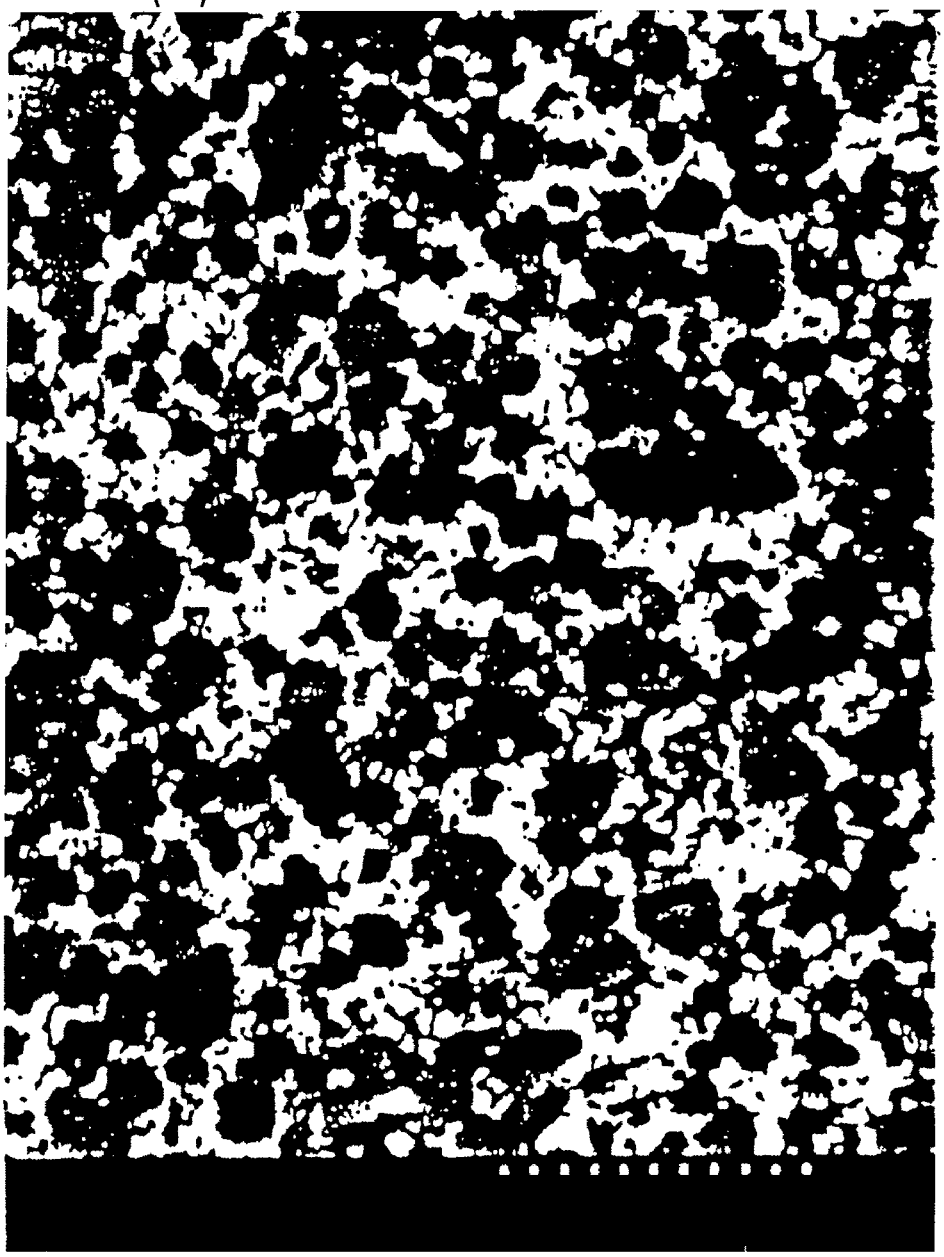
FIG. 9 is a micrography similar to the one of FIG. 7, showing the microstructure of the varistor S2-1,000 (2 h), of which the average diameter of the particles is shown in FIG. 8.

The effect of the sintering time on the grain size of ZnO is better illustrated in FIGS. 6 to 9, which give the distribution of the grain size of ZnO and micrographies of said grains in the case of a S2-1,000 (1 h) varistor (see FIGS. 6 and 7) and a S2-1,000 (2 h) varistor—see FIGS. 8 and 9.

In both cases, the varistors had exactly the same composition as given in example 1 and were prepared in the same manner, except the sintering time at 1,000° C. were 1 and 2 h respectively (instead of 2.5 h).

As can be seen, the average diameter of the ZnO grains is of the order of 1 $\mu$m for the S2-1,000 (1 h) varistors. This average diameter double in the case of the S2-1,000 (2 h) varistor. This again confirms that the sintering time directly influences the grain size and must be accordingly as short as possible to obtain the best results.

Figure 13:
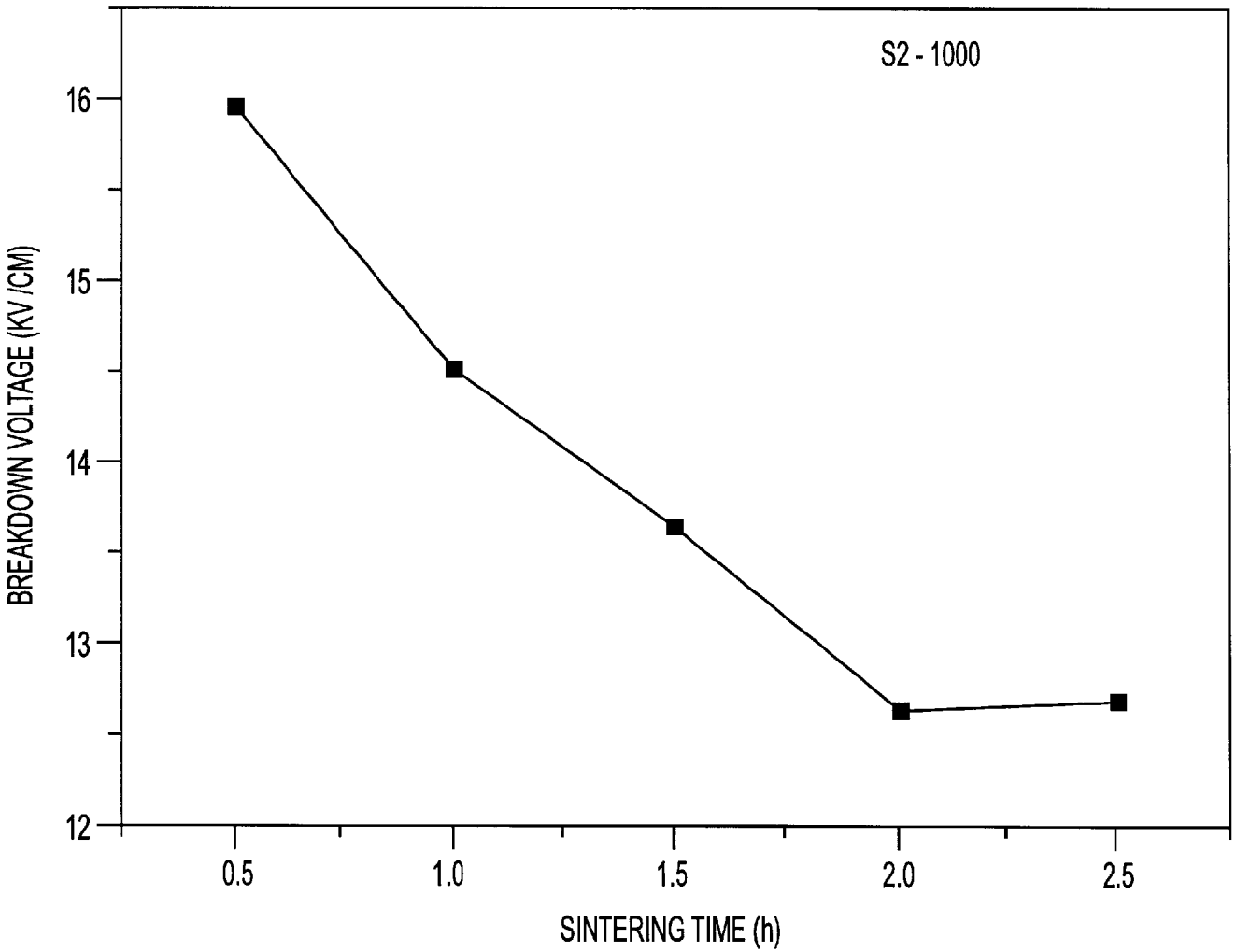
FIG. 13 is a curve giving the value of the break-down voltage (expressed in kV/cm) has a function of the sintering time (expressed in hours) in the case of a varistor S2-1,000 according to the invention.

FIG. 13 is a curve giving the value of the break-down voltage as a function of the sintering time in the case of S2-1,000 varistor having the very same composition as the one of example 1 and having been prepared exactly in the same manner, except for the sintering time at 1,000° C.

It can be observed that, when the sintering time is short (about 0.5 h), the break-down voltage reaches values of about 16 kV/cm. It can also be observed that, when the sintering time exceeds 2h, the break-down voltage seems to stabilize.

EXAMPLE 6

Evaluation of the Importance of the Sintering Temperature

Figure 10:
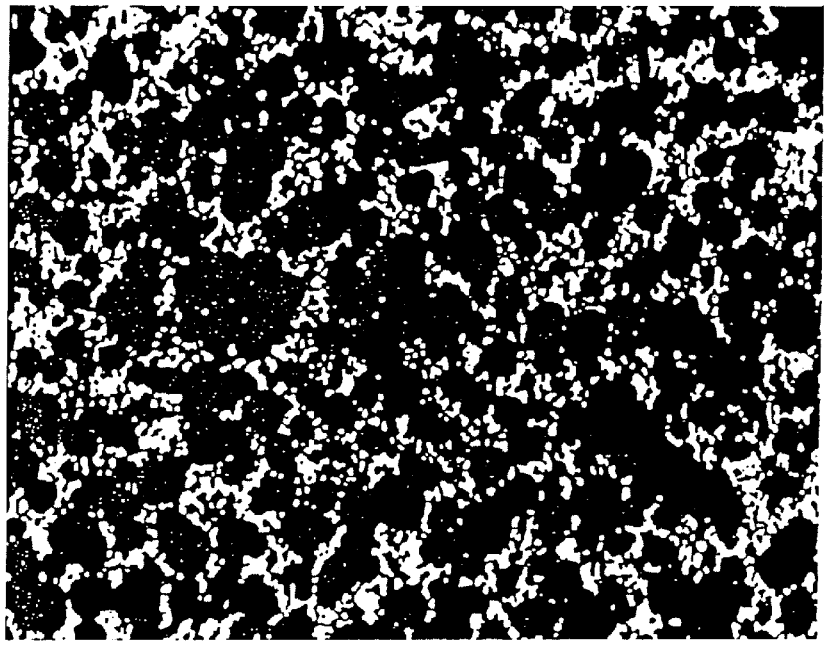
FIGS. 10 and 11 are representations similar to those of FIGS. 7 and 9, showing the microstructure of the varistor S2-1,000 (2.5 h) and S2-1,200 (2.5 h) according to the invention.
Figure 11:
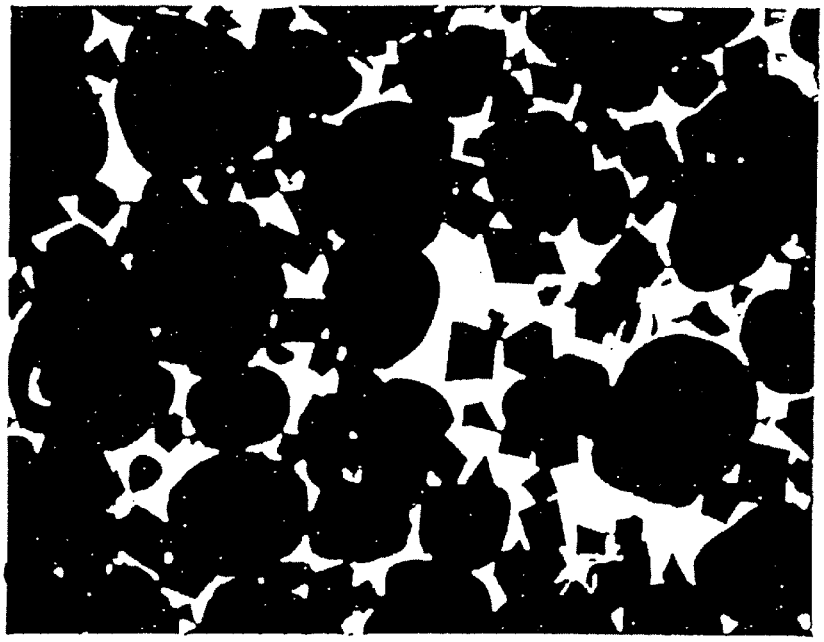

FIG. 10 is a micrography showing the structure of a S2-1,000 (2.5 h) varistor. FIG. 11 is a micrography showing the structure of a S2-1,200 (2.5 h) varistor. On these micrographies, the particles that are black and round, consist of ZnO. As can be seen, they typically have a size equal to about 2 $\mu$m at 1,000° C. and they are wider than 5 $\mu$m at 1,200° C.

Figure 14:
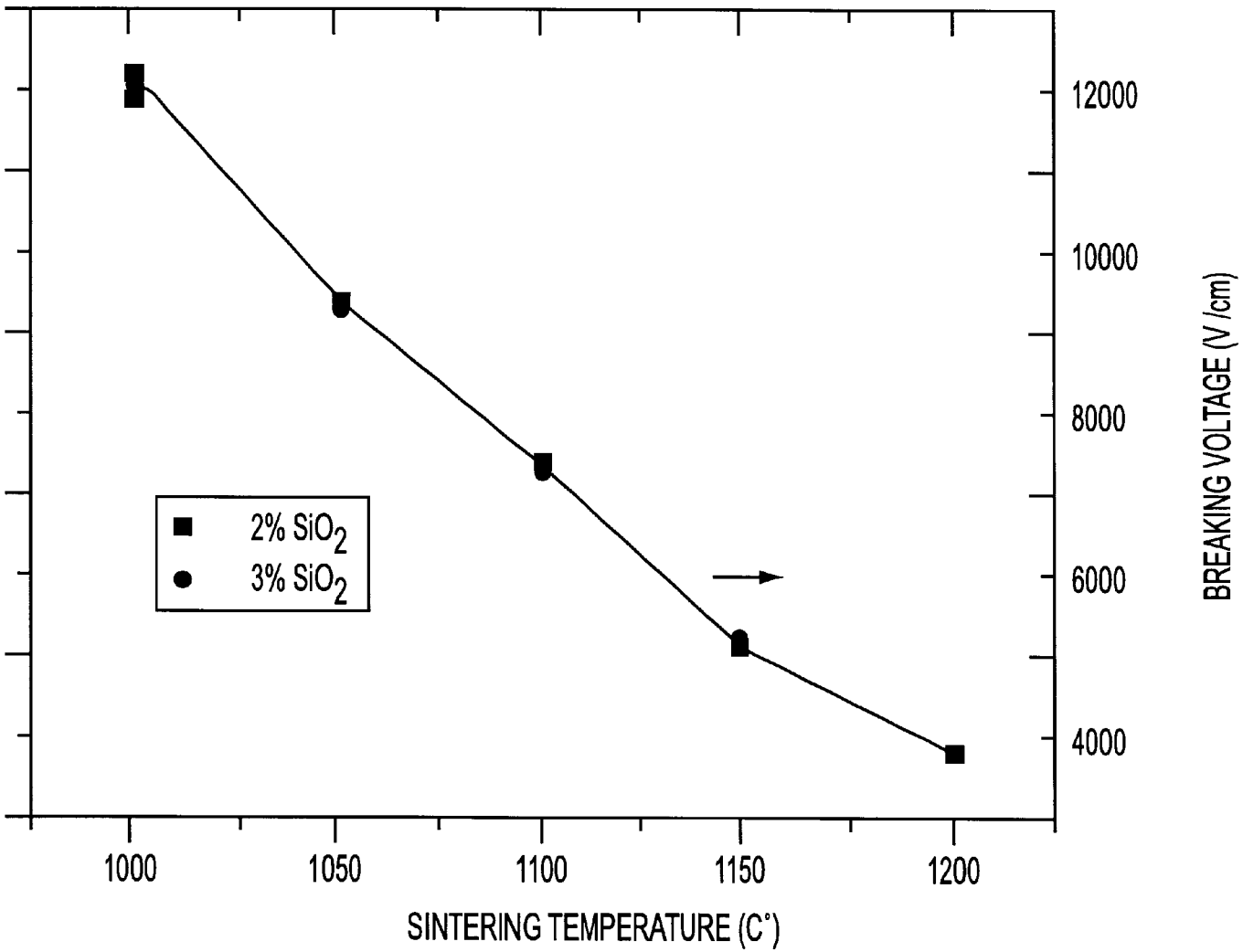
FIG. 14 is a curve giving the value of the break-down voltage as a function of the sintering time in the case of the varistors S2-1,000 and S3-1,000 according to the invention.

FIG. 14 gives the coefficient of non-linearity $\alpha$ and the break-down voltage in the cases of S2 and S3 varistor as a function of the sintering time. Except for the concentration of $SiO_2$, the composition of these varistors were identical to the one disclosed in example 1 (the supplement of $SiO_2$ was made to the detriment of ZnO). Their preparation was also carried out in the same manner, except for the sintering time. As can be seen, the value of the coefficient $\alpha$ is not really influenced by the sintering time. However, whatever be the amount of $SiO_2$ (added to reduce the grain size growth during the sintering), the break-down voltage was reduced from 12.2 kV/cm down to 3.7 kV/cm when the sintering temperature raised from 1,000° C. to 1,200° C.

EXAMPLE 7

Evaluation of the Importance of the Heating Rate

FIG. 16 is a curve giving the value of the porosity as a function of the heating rate in the case of a $S_2$-1,000 (1 h) varistor having exactly the same composition as in example 1 and having been prepared as in example 2, with a calcination carried out for 2.5 h at 550° C., a pressing under a pressure of 450 Mpa, and a sintering of 1 hour at 1,000° C. The difference between each test lied in the heating rate, that is in the speed at which the pressed powder-binder mixture was heated to reach the selected sintering temperature of 1,000° C.

As can be seen, the heating rate has a strong influence on the porosity which, in order to obtain a good varistor, must be as low as possible. Thus, it can be seen that the slower is the heating rate, the lower is the porosity. On the contrary, if the heating rate is too slow, then there is a risk to speed too much time at high temperatures, with the problem that such generates (see example 5).

From a practical standpoint, one will select a heating rate in a range of 0.5 to 10° C./min, the preferred rate being 1° C./min.

EXAMPLE 8

Evaluation of the Importance of the Milling Time

Figure 12:
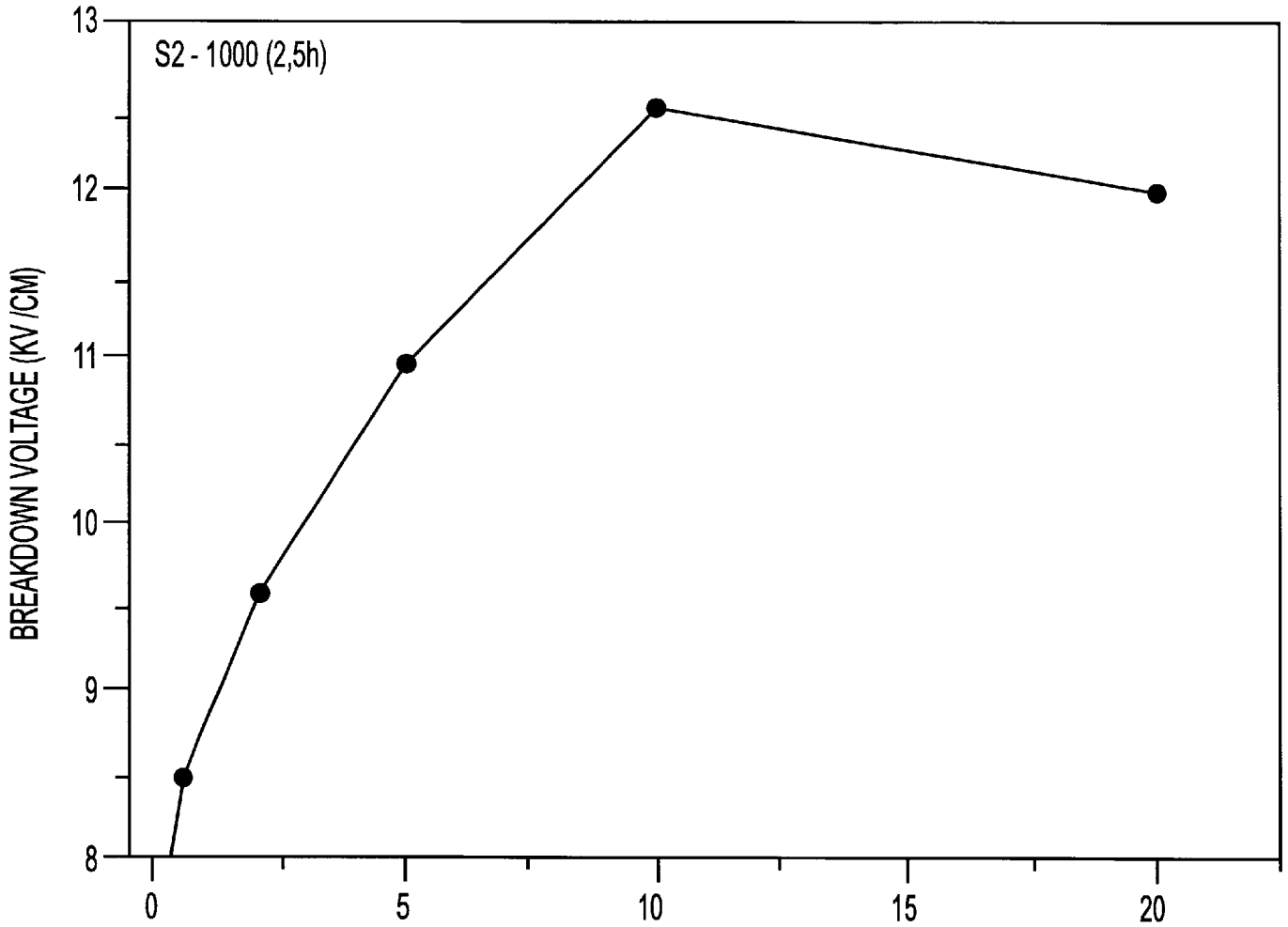
FIG. 12 is a curve giving the value of the break-down voltage (expressed in kV/cm) as a function of the milling time (expressed in hours), in the case of a varistor S2-1,000 (2 h) according to the invention.

FIG. 12 is a curve giving the break-down voltage as a function of the milling time in the case of a S2-1,000 (2.5 h)

varistor having exactly the same composition than the one of example 1, and having been prepared in the same manner with the same equipment, except for the duration of the original milling.

As can be seen, the break-down voltage reached a maximum value of about 12.5 kV/cm after 10 hours of milling. This figure shows the importance of the intensive mechanical grinding (milling) and, accordingly, of the so-obtained nanocrystalline structure on the properties of the varistors.

EXAMPLE 9

Evaluation of the Importance of the Addition of $SiO_2$

As previously indicated, silica ($SiO_2$) is an additive that is particularly useful inasmuch as it is known to reduce grain growth. However, it is also known and clearly demonstrated by the test reported hereinabove that the break-down voltage is inversely proportional to the grain size of ZnO.

Figure 15:
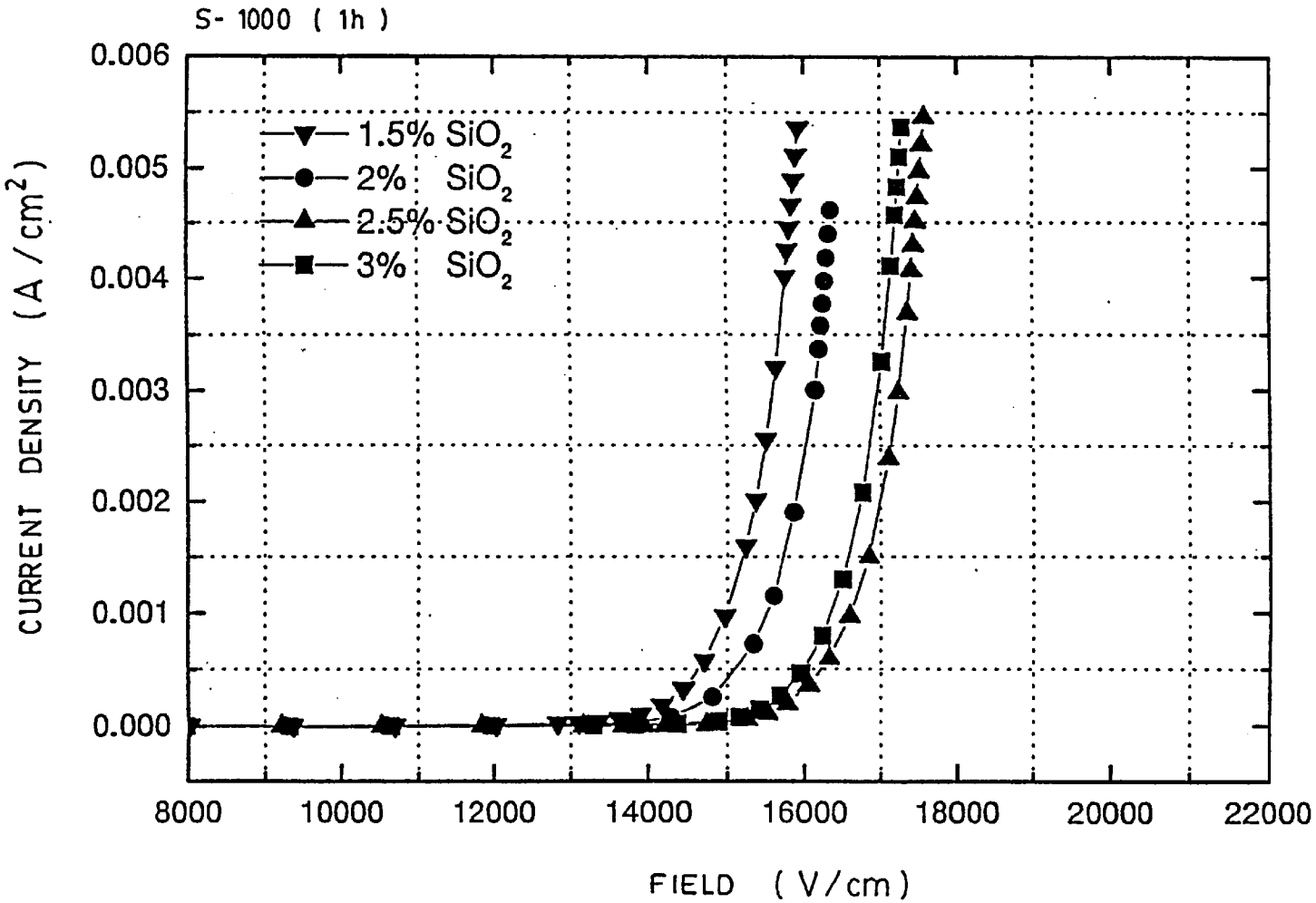
FIG. 15 is a curve giving the value of the current density (expressed in A/cm$^2$) as a function of the electric field (expressed in V/cm) and the molar percentage of $SiO_2$ added during the mixture of powders used for the manufacture of varistors of the type S-1,000 (1 h)

FIG. 15 illustrates the current density as a function of the voltage field and, accordingly, of the break-down voltage in the case of a varistor identical to the one of example 1, that is a varistor of the type S-1,000 (2.5 h), except that the amount of silica (expressed in percentage mole) was modified to the detriment of the amount of ZnO and the sintering time was 1 h.

As can be seen, the addition of $SiO_2$ modifies the electric behaviour. This modification is maximum with the addition of 2.5% mol $SiO_2$.

EXAMPLE 10

Evaluation of the Importance of the Addition of Other Additives

In order to demonstrate the importance of some of the additives, different mixtures were prepared and tested. The tests were carried out on varistors of the S2-1,000 (1 h) type, wherein the amount of some other additives (expressed in % mol) was varied to the detriment of ZnO. $Al_2O_3$ was not added to the mixtures that were used.

Figure 17:
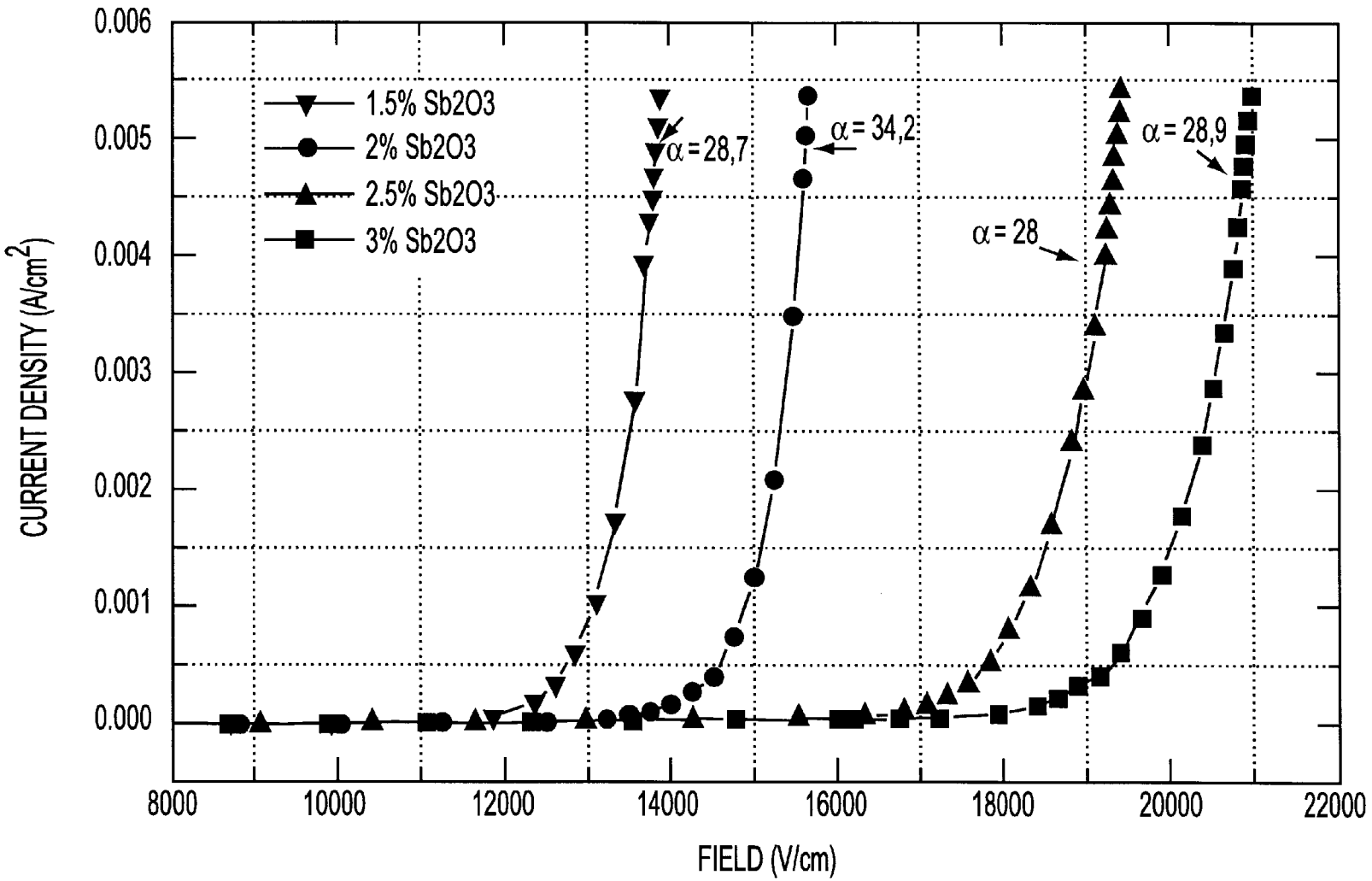
FIG. 17 is a curve similar to the one of FIG. 15, giving the value of the current density as a function of the electric field and the molar percentage of $Sb_2O_3$ added to the mixture of powders used for the manufacture of a varistor of the type S2-1,000 (1 h)

FIG. 17 shows the influence of $Sb_2O_3$. The test reported on this figure was carried out on S2-1,000 (1 h) varistors. $Sb_2O_3$ is known to reduce grain growth and to prevent the transfer of ions in the bismuth-rich phase during the consolidation treatment (sintering). As can be seen, an increase in the percentage of $Sb_2O_3$ resulted in a substantial increase in the break-down voltage, which reached up to 20 kV/cm. However, the coefficient $\alpha$ seemed to reach its maximum value at 2% mol of $Sb_2O_3$.

Figure 18:
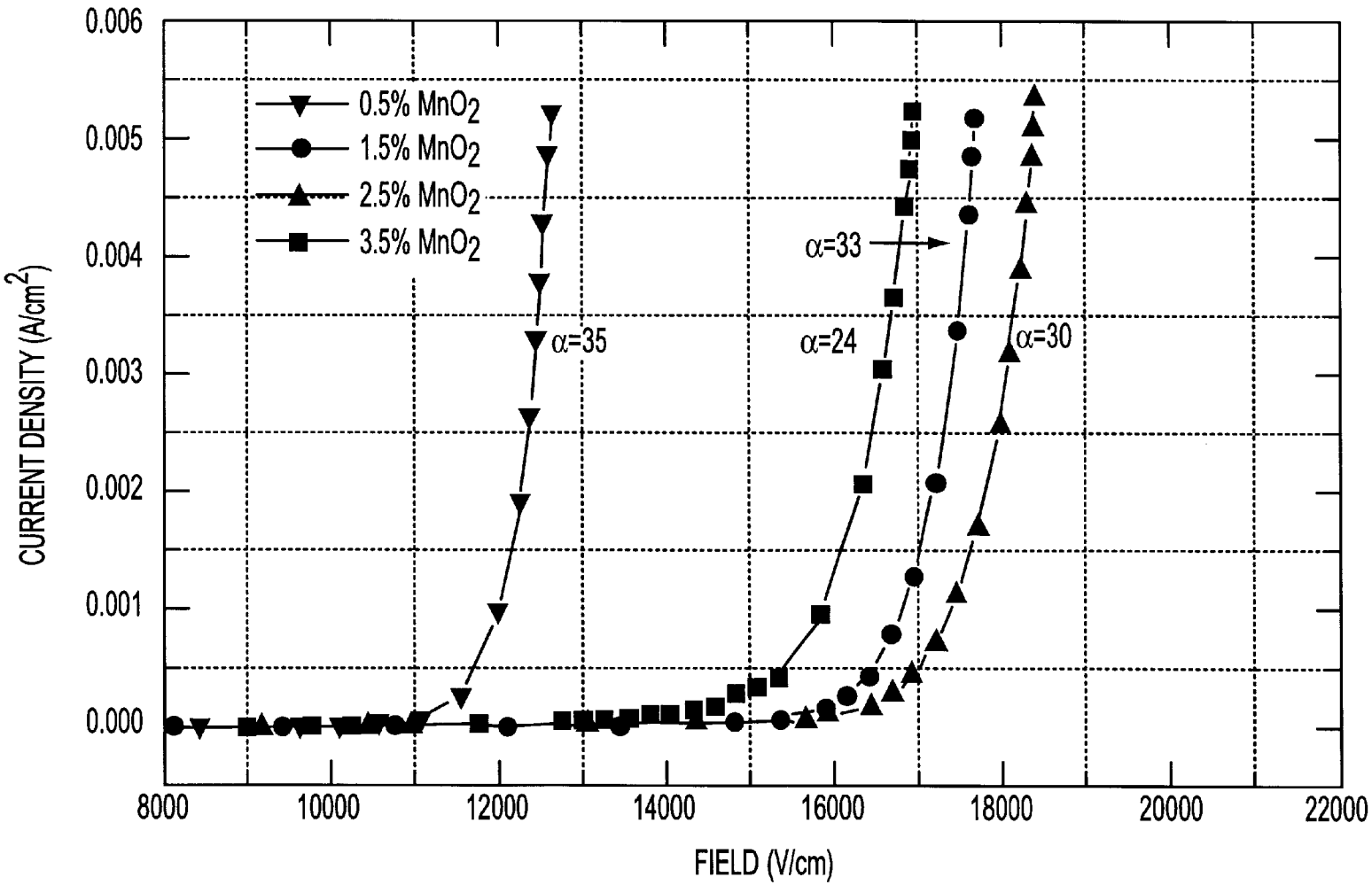
FIG. 18 is a curve similar to the one of FIG. 15, giving the value of the current density as a function of the electric field and the molar percentage of $MnO_2$ added to the mixture of powders used for the manufacture of a varistor of the type S2-1,000 (1 h)

FIG. 18 shows the influence of $MnO_2$. The tests were carried out on S2-1,000 (1 h) varistor. As can be seen, the addition of $MnO_2$ up to 2.5 mol % to the detriment of ZnO substantially increased the break-down voltage. However, above 2.5 mol %, there was a reduction in the break-down voltage.

Figure 19:
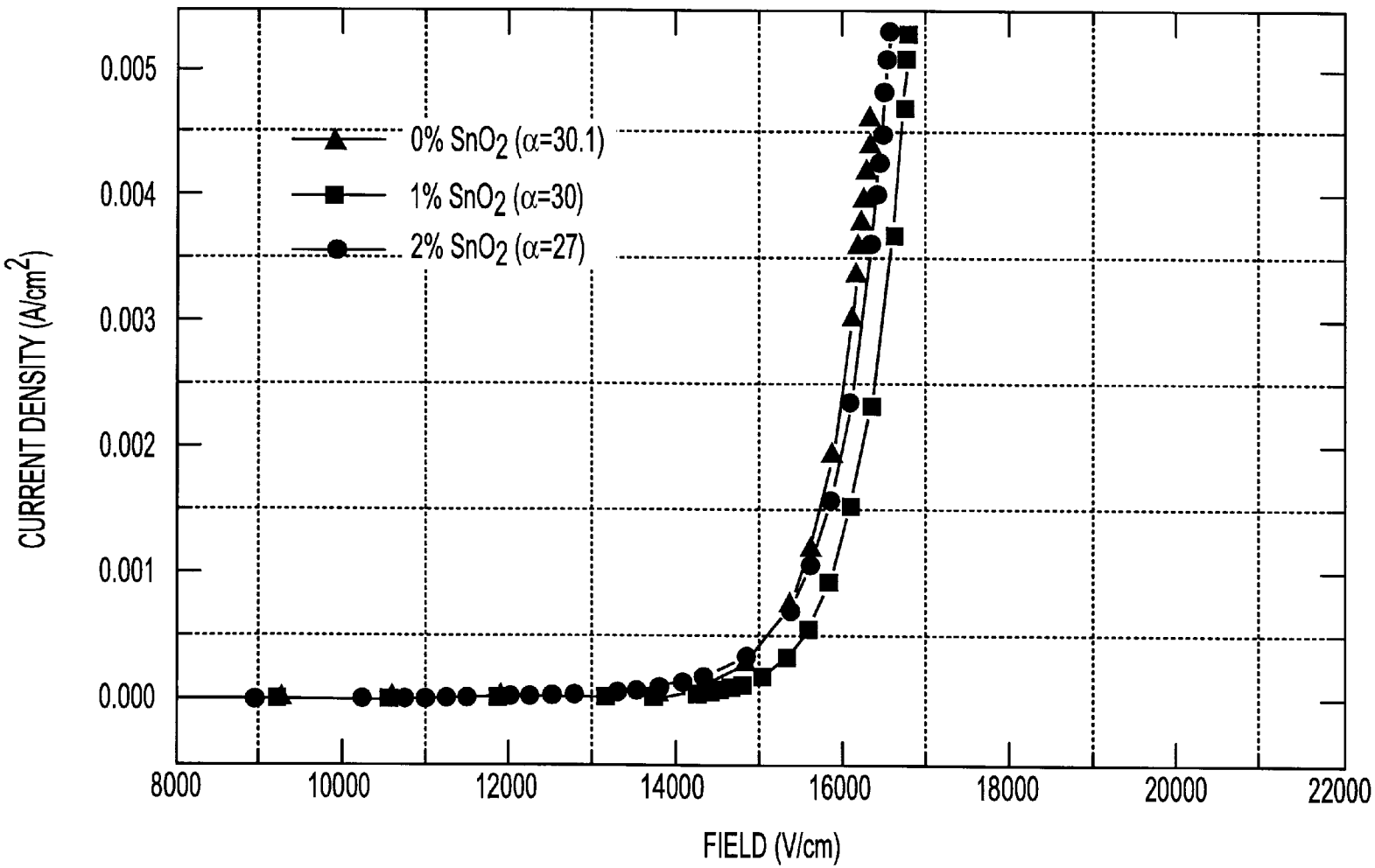
FIG. 19 is a curve similar to the one of FIG. 15, giving the value of the current density has a function of a field and the molar percentage of $SnO_2$ added to the mixture of powders used for the manufacture of a varistor of the type S2-1,000 (1 h)

FIG. 19 shows the influence of $SnO_2$. The tests were carried out on S2-1,000 (1 h) varistors. As can be seen, the addition of $SnO_2$ did not seem to influence the value of the break-down voltage. Similarly, the coefficient $\alpha$ shows very small variations. However, this test shows that it is possible to replace zinc oxide by another additive without influencing the electrical property of the resulting varistor.

Figure 20:
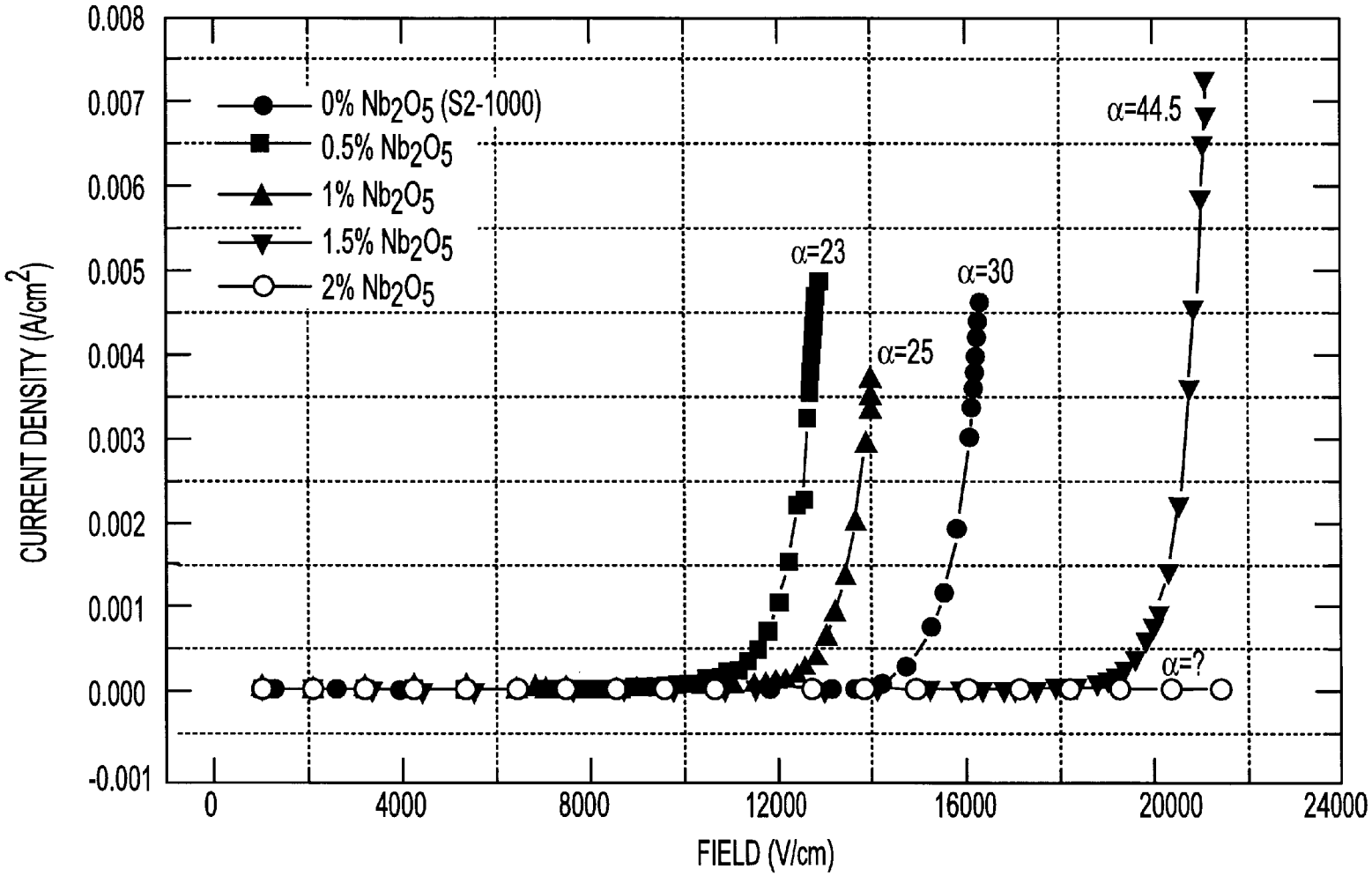
FIG. 20 is a curve similar to the one of FIG. 15, giving the value of the current density as a function of the electric field and the molar percentage of $Nb_2O_5$ added to the mixture of powders used for the manufacture of a varistor of the type S2-1,000 (1 h).

Last of all, FIG. 20 shows the influence of $Nb_2O_5$. These tests were carried out on a S2-1,000 (1 h) varistor. As can be seen, the addition of $Nb_2O_5$ substantially increased not only the break-down voltage but also the coefficient $\alpha$.

In view of the results of these tests, the Applicant believes that one could easily manufacture very efficient varistors with as low as 75% mol of ZnO, the balance consisting of $Bi_2O_3$ and other performing additives.

It is obvious that numerous modifications or variants could be made to what has just been disclosed and illustrated hereinabove without departing from the scope of the invention as defined in the appended claims.

What is claimed is:

1. A method for the manufacture of a varistor having a very high breakdown voltage, comprising:

(a) mixing powders of zinc oxide (ZnO) and bismuth oxide ($Bi_2O_3$) with at least one other powder of an additive capable of influencing the properties of the varistance, said mixing being carried out with such amounts of powders that the zinc oxide represents at least 75 mol % of the resulting mixture;

(b) subjecting said powders to an intensive milling before, during, or after their mixing, by means of a high energy ball mill in such a manner that the obtained powders be nanocrystalline; and (c) subjecting the so milled mixture to a consolidation treatment wherein said consolidation treatment includes a sintering and is carried out under time and temperature conditions selected to keep a zinc oxide grain size lower than 3 $\mu$m.

2. The method according to claim 1, characterized in that the intensive milling step (b) is carried out after the powder mixing step (a).

3. The method according to claim 2, characterized in that before the mixing of step (a), the zinc oxide powder used as a starting material is milled either alone or in combination with one or more doping agents, and the powder of bismuth oxide is mixed with all the other additives, the so-obtained mixture of bismuth oxide with the other additives being then milled and processed at a high temperature.

4. The method according to claim 1, characterized in that:

(d) before carrying out step (c) the powders or their mixture are calcinated at a temperature equal to or lower than 550° C.

5. The method according to claim 4, characterized in that:

(e) after the calcination of the step (d) and before carrying out step (c), a binder is introduced into the mixture of milled powders and the obtained mixture wherein the binder has been introduced, is subjected to a pressing to form pellets that are then subjected to the consolidation treatment of step (c).

6. The method according to claim 5, characterized in that the binder is polyvinyl alcohol and this alcohol is introduced into the mixture of powders by ball milling.

7. The method according to claim 1, characterized in that the consolidation treatment of step (c) includes or is followed by a heating.

8. The method according to claim 7, characterized in that the heating is selected from the group consisting of convection heating, induction heating, microwave heating, laser heating and electric discharge heating.

9. The method according to claim 8, characterized in that the heating is carried out for one or several short periods of time.

10. The method according to claim 1, characterized in that the sintering of step (c) is carried out at a temperature lower than 1,200° C. for a period of time equal to or lower than 2.5 hours.

11. The method according to claim 10, characterized in that the sintering is carried out at a temperature of about 1,000° C.

12. The method according to claim 10, characterized in that the sintering is carried out for a period of time equal to or lower than 1.5 hours.

13. The method according to claim 10, characterized in that the sintering is carried out with a heating rate comprised between 0.5 and 10° C./min.

14. The method according to claim 13, characterized in that the sintering is carried out with a heating rate of about 1° C./min.

15. The method according to claim 14, characterized in that the additive(s) capable of influencing the properties of the varistors, is (are) selected from the group consisting of metal oxides, carbides, nitrides, nitrates and hydrides that are capable of doping the varistors, modifying the characteristics of their current-voltage curves, modifying the resistivity of phases, reducing their leakage current, increasing their capacity of dissipating energy, controlling their porosity, slowing down the grain of growth, increasing their structural integrity, altering the melting points of the phases and increasing their chemical, electrical, mechanical and thermal stabilities.

16. The method according to claim 15, characterized in that the additive(s) is (are) selected from the group consisting of metal oxides, carbides, nitrides, nitrates and hydrides of the following elements: Si, Sb, Mn, Ge, Sn, Pb, Nb, B, Al, Ti, Ta, Fe, S, F, Li, Ni, Cr, Mo, W, Be, Br, Ba, Co, Pr, U, As, Ag, Mg, V, Cu, C, Zr, Se, Te and Ga.

17. The method according to claim 16, characterized in that said at least one other powder of an additive is selected from the group consisting of antimony oxide ($Sb_2O_3$), manganese oxide ($MnO_2$), alumina ($Al_2O_3$), silica ($SiO_2$) tin oxide ($SnO_2$), niobium oxide ($Nb_2O_5$) cobalt oxide (CoO or $Co_3O_4$), iron oxide ($Fe_2O_3$ or $Fe_3O_4$) and titanium oxide ($TiO_2$ or TiO).

18. The method according to claim 17, characterized in that the mixture prepared during step (a) comprises:

from 0.25 to 10 mol % $Bi_2O_3$ from 1.5 to 4 mol % $Sb_2O_3$ from 0.5 to 4 mol % $MnO_2$ from 0.00125 to 0.05 mol % $Al_2O_3$ from 0 to 4 mol % Of $SiO_2$ from 0 to 2 mol % $SnO_2$ from 0 to 2 mol % $Nb_2O_5$ from 0 to 2.5 mol % CoO from 0 to 2.5 mol % $Fe_2O_3$ and from 0 to 3 mol % $TiO_2$ the balance consisting of ZnO.

19. The method according to claims 15, characterized in that the mixture prepared in step (a) comprises:

90.495 mol % ZnO 3 mol % $Bi_2O_3$ 2 mol % $Sb_2O_3$ 2.5 mol % $MnO_2$ 2 mol % $SiO_2$ 0.005 mol % $Al_2O_3$.

20. The method according to claim 1, wherein said consolidation treatment is carried out under time and temperature conditions selected to keep the zinc oxide grain size lower than 3 $\mu$m and a porosity equal to or less than approximately 7%.

21. The method according to claim 1, wherein said consolidation treatment is carried out under time and temperature conditions selected to keep the zinc oxide grain size lower than 3 $\mu$m and a porosity equal to or less than approximately 1%.

* * * * *

UNITED STATES PATENT AND TRADEMARK OFFICE

CERTIFICATE OF CORRECTION

PATENT NO. : 6,620,346 B1
APPLICATION NO. : 09/485401
DATED : September 16, 2003
INVENTOR(S) : Robert Schulz et al.

It is certified that error appears in the above-identified patent and that said Letters Patent is hereby corrected as shown below:

IN THE ABSTRACT

Line 10, delete "3mu m", insert --3μm--

Line 12, delete "length", insert --unit length--

Line 20, delete "weaker", insert --lower--

IN THE SPECIFICATION

Column 4, line 24, delete "1,200", insert --10-- line 31, delete "ox", insert --α--

Column 7, line 34, delete "a", insert --α-- line 56, remove the dot after --C--

Column 10, line 67, delete "1h", insert --10h--

Column 11, line 36, delete "a", insert --α--

Column 12, line 44, delete "$S_2$", insert --S2-- line 57, delete "speed", insert --spend--

Signed and Sealed this

Twentieth Day of February, 2007

JON W. DUDAS
*Director of the United States Patent and Trademark Office*